US009005862B2

(12) United States Patent
Nagayama et al.

(10) Patent No.: US 9,005,862 B2
(45) Date of Patent: Apr. 14, 2015

(54) TONER, IMAGE FORMING METHOD, AND PROCESS CARTRIDGE

(71) Applicants: Masashi Nagayama, Shizuoka (JP); Hisashi Nakajima, Shizuoka (JP); Saori Yamada, Shizuoka (JP); Shinya Hanatani, Kanagawa (JP); Mariko Takii, Kanagawa (JP); Yoshitaka Sekiguchi, Shizuoka (JP)

(72) Inventors: Masashi Nagayama, Shizuoka (JP); Hisashi Nakajima, Shizuoka (JP); Saori Yamada, Shizuoka (JP); Shinya Hanatani, Kanagawa (JP); Mariko Takii, Kanagawa (JP); Yoshitaka Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/826,791

(22) Filed: Mar. 14, 2013

(65) Prior Publication Data

US 2013/0260307 A1 Oct. 3, 2013

(30) Foreign Application Priority Data

Apr. 3, 2012 (JP) ..... 2012-084571
Mar. 7, 2013 (JP) ..... 2013-045239

(51) Int. Cl.
*G03G 9/08* (2006.01)
*G03G 13/20* (2006.01)
(Continued)

(52) U.S. Cl.
CPC ..... *G03G 9/08* (2013.01); *G03G 13/20* (2013.01); *G03G 21/18* (2013.01); *G03G 9/081* (2013.01); *G03G 9/0821* (2013.01); *G03G 9/0825* (2013.01); *G03G 9/08755* (2013.01);
(Continued)

(58) Field of Classification Search
CPC ..... G03G 9/08755
USPC ..... 430/109.4, 111.4
See application file for complete search history.

(56) References Cited

U.S. PATENT DOCUMENTS

2008/0102393 A1 5/2008 Hasegawa
2008/0226356 A1 9/2008 Yasunaga et al.
(Continued)

FOREIGN PATENT DOCUMENTS

JP 60-090344 5/1985
JP 62-063940 3/1987
(Continued)

OTHER PUBLICATIONS

Office Action issued May 22, 2014 in Korean Patent Application No. 10-2013-0033590.
(Continued)

*Primary Examiner* — Mark A Chapman
(74) *Attorney, Agent, or Firm* — Oblon, McClelland, Maier & Neustadt, L.L.P.

(57) ABSTRACT

A toner including a crystalline polyester resin (A), an amorphous resin (B), and a composite resin (C) having a condensation polymerization resin unit and an addition polymerization resin unit is provided. A molecular weight distribution of the toner based on THF-soluble contents thereof has a main peak within a molecular weight range from 1,000 to 10,000 and a half bandwidth of the main peak is 15,000 or less. The molecular weight distribution is determined by gel permeation chromatography. The toner includes chloroform-insoluble contents. A ratio C/R of the toner is within a range from 0.03 to 0.55. C and R represent heights of spectrum peaks specific to the crystalline polyester resin (A) and the amorphous resin (B), respectively, determined by a Fourier transform infrared spectroscopic attenuation total reflection method after the toner is stored in a thermostatic chamber at 45° C. for 12 hours.

17 Claims, 7 Drawing Sheets

(51) Int. Cl.
*G03G 21/18* (2006.01)
*G03G 9/087* (2006.01)

(52) U.S. Cl.
CPC ..... *G03G9/08786* (2013.01); *G03G 9/08795* (2013.01); *G03G 9/08797* (2013.01)

(56) References Cited

U.S. PATENT DOCUMENTS

| | | | |
|---|---|---|---|
| 2008/0227003 | A1 | 9/2008 | Honda et al. |
| 2008/0280219 | A1 | 11/2008 | Nakayama et al. |
| 2010/0291481 | A1 | 11/2010 | Yamada et al. |
| 2010/0316944 | A1 | 12/2010 | Nakajima et al. |
| 2011/0081608 | A1 | 4/2011 | Yaguchi et al. |
| 2012/0052434 | A1 | 3/2012 | Sugimoto et al. |
| 2012/0251169 | A1 | 10/2012 | Aoki et al. |

FOREIGN PATENT DOCUMENTS

| | | | |
|---|---|---|---|
| JP | 64-015755 | | 1/1989 |
| JP | 2-082267 | | 3/1990 |
| JP | 3-041470 | | 2/1991 |
| JP | 3-229264 | | 10/1991 |
| JP | 11-249339 | | 9/1999 |
| JP | 11-305486 | | 11/1999 |
| JP | 2001-222138 | | 8/2001 |
| JP | 2002-082484 | | 3/2002 |
| JP | 2002-162785 | | 6/2002 |
| JP | 2004-046095 | | 2/2004 |
| JP | 2004-333759 | | 11/2004 |
| JP | 2005-338814 | | 12/2005 |
| JP | 3869968 | B2 | 1/2007 |
| JP | 2007-033773 | | 2/2007 |
| JP | 2007-065620 | | 3/2007 |
| JP | 2007-206097 | | 8/2007 |
| JP | 2008-262172 | | 10/2008 |
| JP | 2008-310280 | | 12/2008 |
| JP | 2011-100106 | | 5/2011 |
| JP | 2012-58425 | | 3/2012 |

OTHER PUBLICATIONS

Extended European Search Report issued Jul. 23, 2013, in European Patent Application No. 13160433.2.
U.S. Appl. No. 13/617,957, filed Sep. 14, 2012, Nagayama, et al.
U.S. Appl. No. 13/799,862, filed Mar. 13, 2013, Nakajima, et al.
U.S. Appl. No. 13/826,742, filed Mar. 14, 2013, Nakajima, et al.
U.S. Appl. No. 13/827,972, filed Mar. 14, 2013, Yamada, et al.
U.S. Appl. No. 13/822,433, filed Mar. 12, 2013, Watanabe, et al.
Office Action issued Nov. 18, 2014, in Korean Patent Application No. 10-2013-0033590, filed Mar. 28, 2013.

TONER, IMAGE FORMING METHOD, AND PROCESS CARTRIDGE

CROSS-REFERENCE TO RELATED APPLICATIONS

This patent application is based on and claims priority pursuant to 35 U.S.C. §119 to Japanese Patent Application Nos. 2012-084571 and 2013-045239, filed on Apr. 3, 2012 and Mar. 7, 2013, respectively, in the Japan Patent Office, the entire disclosure of each of which is hereby incorporated by reference herein.

BACKGROUND

1. Technical Field

The present disclosure relates to a toner, and an image forming method and a process cartridge using the toner.

2. Description of Related Art

In the field of electrophotography, recently, toner is required to be fixable at much lower temperatures for the objective of saving energy as well as meeting demands for improving printing speed and image quality.

Generally, as the printing speed of an electrophotographic image forming apparatus increases, the resulting image quality decreases mainly because a defective fixation of toner occurs.

In the process of fixing toner (hereinafter the "fixing process"), a toner image is fixed on a recording medium, such as paper, by application of heat and pressure. When the printing speed gets higher, the toner image is supplied with less heat energy and is defectively fixed on the recording medium. The defectively-fixed toner image may have a rough surface or may generate a residual image (this phenomenon is hereinafter called as "cold offset"). Such deterioration of the toner image caused by a high printing speed may be prevented by increasing the fixing temperature. However, increasing the fixing temperature is not the best solution because the high fixing temperature adversely affects the other image forming processes, accelerates deterioration of the fixing members, and increases consumption energy.

In view of this situation, toner itself is required to improve the fixing performance, i.e., to be fixable at much lower temperatures, especially in high-speed image forming apparatuses.

One attempt to improve the fixing performance of toner involves controlling thermal properties, such as the glass transition temperature (Tg) and the softening temperature (T1/2), of its binder resins. However, lowering Tg may cause deterioration of heat-resistant storage stability and lowering T1/2 (e.g., lowering the molecular weight of the binder resins) may cause the hot offset problem. Merely controlling thermal properties of the binder resins does not provide a toner having a good combination of low-temperature fixability, heat-resistant storage stability, and hot offset resistance.

JP-S60-90344-A, JP-S64-15755-A, JP-H02-82267-A, JP-H03-229264-A, JP-H03-41470-A, and JP-H11-305486-A each propose polyester binder resins, having low-temperature fixability and heat-resistant storage stability, in place of styrene-acrylic binder resins having been widely used so far.

JP-S62-63940-A proposes a non-olefin-based crystalline polymer binder which sharply melts at the glass transition temperature, for improving low-temperature fixability.

JP-2931899-B2 (corresponding to JP-H11-249339-A) and JP-2001-222138-A each propose crystalline polyester binders which sharply melt, for improving low-temperature fixability.

The crystalline polyester described in JP-2931899-B2 has a low acid value of 5 or less and a low hydroxyl value of 20 or less.

JP-2004-46095-A describes a toner having a sea-island phase separation structure formed of a crystalline polyester resin and an amorphous polyester resin which are incompatible with each other.

JP-2007-33773-A describes a toner within which a crystalline polyester resin is properly dispersed and having a specific endothermic profile determined by differential scanning calorimetry, for giving low-temperature fixability and heat-resistant storage stability to toner.

JP-2005-338814-A describes a toner including a relatively large amount of a crystalline polyester resin.

JP-4118498-B2 (corresponding to JP-2002-082484-A) describes a toner having a specific molecular weight distribution, including a certain amount of chloroform-insoluble contents, and including two or more kinds of binder resins each having different softening temperatures.

JP-2007-206097-A describes a toner including a crystalline polyester resin and an amorphous resin in which a ratio of the heights of peaks specific to the crystalline polyester resin and the amorphous resin determined by a Fourier transform infrared spectroscopy total reflection method after the toner is stored in a thermostatic chamber at 45° C. for 12 hours.

In a process called developing process, toner particles having been charged in a developing unit are transferred onto a latent image formed on an image bearing member so that the latent image is developed into a toner image. Depending on the moving speed of the image bearing member, for example, when the moving speed of the latent image bearing member is relatively high, the developing unit may employ multiple magnetic developing rollers so as to extend the developing area as well as the developing time period.

The developing unit employing multiple magnetic developing rollers (hereinafter "multistage developing unit") has a higher developing ability than that employing only one developing roller, and can be applicable to large-area-image printing while improving image quality. Additionally, in such a multistage developing unit, the toner content in a two-component developer can be reduced and the rotational speed of the developing rollers can be reduced. As a result, the occurrence of toner scattering and carrier deterioration is prevented and the lifespan of the two-component developer is extended.

JP-2011-100106-A describes a toner including a crystalline polyester.

SUMMARY

In accordance with some embodiments, a toner including a crystalline polyester resin (A), an amorphous resin (B), and a composite resin (C) having a condensation polymerization resin unit and an addition polymerization resin unit is provided. A molecular weight distribution of the toner based on THF-soluble contents thereof has a main peak within a molecular weight range from 1,000 to 10,000 and a half bandwidth of the main peak is 15,000 or less. The molecular weight distribution is determined by gel permeation chromatography. The toner includes chloroform-insoluble contents. A ratio C/R of the toner is within a range from 0.03 to 0.55. C and R represent heights of spectrum peaks specific to the crystalline polyester resin (A) and the amorphous resin (B), respectively, determined by a Fourier transform infrared spectroscopic attenuation total reflection method after the toner is stored in a thermostatic chamber at 45° C. for 12 hours.

In accordance with some embodiments, an image forming method is provided. The method includes forming an electrostatic latent image on an image bearing member. The method further includes developing the electrostatic latent image into a toner image with the above toner. The method further includes transferring the toner image from the latent image bearing member onto a recording medium. The method further includes fixing the toner image on the recording medium.

In accordance with some embodiments, a process cartridge detachably mountable on image forming apparatus is provided. The process cartridge includes an image bearing member and a developing device adapted to develop an electrostatic latent image on the image bearing member into a toner image with a developer including the above toner and a carrier.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
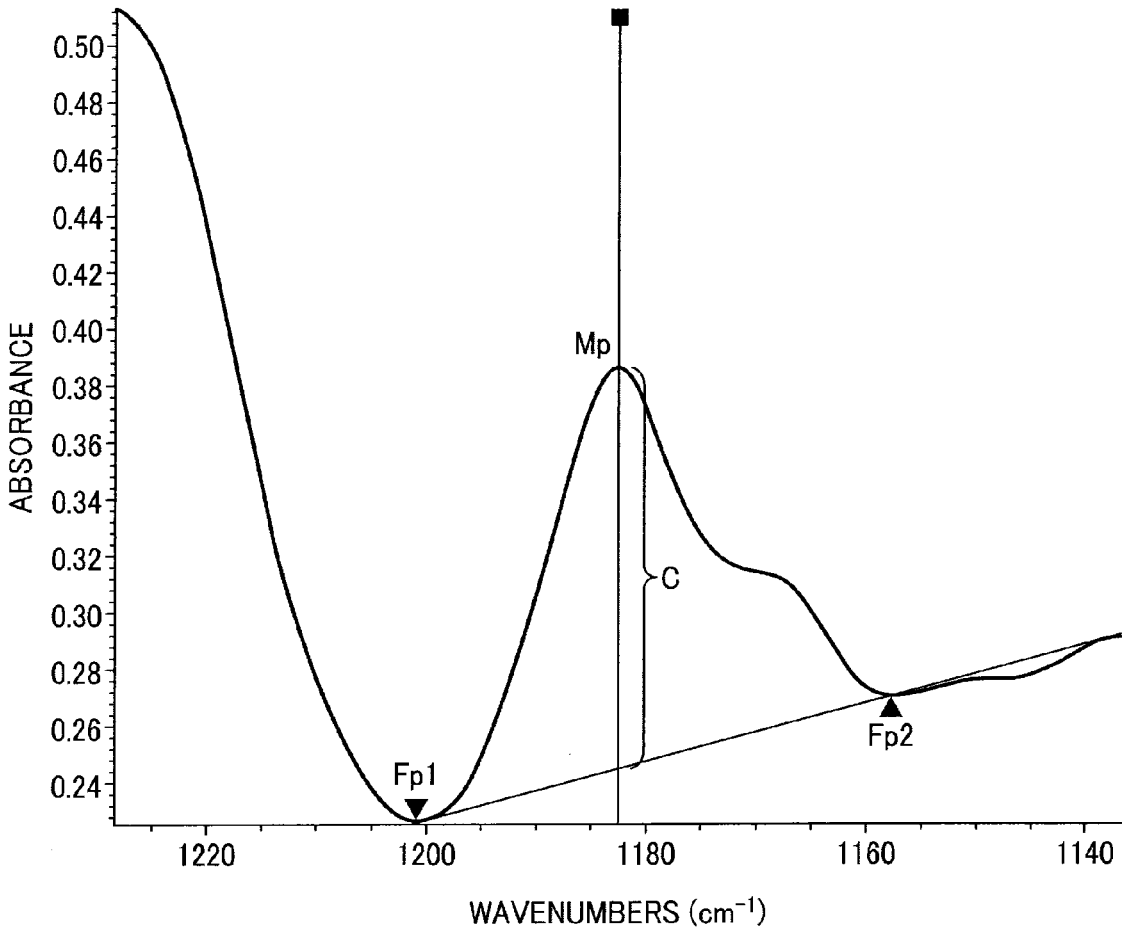
FIG. 1 is an infrared absorption spectrum of a crystalline polyester resin according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A toner according to an embodiment includes a crystalline polyester resin (A), an amorphous resin (B), and a composite resin (C) having a condensation polymerization resin unit and an addition polymerization resin unit. A molecular weight distribution of the toner based on THF-soluble contents thereof has a main peak within a molecular weight range from 1,000 to 10,000 and a half bandwidth of the main peak is 15,000 or less. The molecular weight distribution is determined by gel permeation chromatography. The toner includes chloroform-insoluble contents. A ratio C/R of the toner is within a range from 0.03 to 0.55. C and R represent heights of spectrum peaks specific to the crystalline polyester resin (A) and the amorphous resin (B), respectively, determined by a Fourier transform infrared spectroscopic attenuation total reflection method after the toner is stored in a thermostatic chamber at 45° C. for 12 hours.

In the field of electrophotography, recently, toner is required to be fixable at much lower temperatures for the objective of saving energy as well as meeting demands for improving printing speed and image quality.

One approach to make toner fixable at much lower temperatures is to lower the softening temperature (e.g., T1/2 temperature) of the toner. However, lowering of the softening temperature is generally accompanied by lowering of the glass transition temperature that is further accompanied by deterioration of heat-resistant storage stability of the toner. Additionally, the upper limit of the fixable temperature range, within which the toner is fixable without degrading image quality, is lowered. In other words, hot offset resistance of the toner deteriorates. Thus, it is generally understood in the art that it is difficult to obtain a toner having a good combination of low-temperature fixability, heat-resistant storage stability, and hot offset resistance.

The crystalline polyester resin (A) gives low-temperature fixability and heat-resistant storage stability to toner owing to its sharply-melting property.

However, if the crystalline polyester resin (A) is a sole binder resin in a toner, hot offset resistance is poor and the fixable temperature range is very narrow. Such a toner cannot be put into practical use.

The inventors of the present invention have found that the combination of the crystalline polyester resin (A) and the amorphous resin (B) having chloroform-insoluble contents improves hot offset resistance and widens the fixable temperature range.

When only the crystalline polyester resin (A) and the amorphous resin (B) having chloroform-insoluble contents are included in a toner with the amount of the chloroform-insoluble contents being excessive, low-temperature fixability of the toner is poor. By contrast, when the amount of the crystalline polyester resin (A) is excessive, the crystalline polyester resin (A) dissolves in non-chloroform-insoluble contents of the amorphous resin (B) when they are melted and kneaded in the process of manufacturing toner. As a result, the glass transition temperature of the amorphous resin (B) is considerably lowered and heat-resistant storage stability of the resulting toner significantly deteriorates.

When a molecular weight distribution of the toner based on THF-soluble contents thereof, determined by gel permeation chromatography (hereinafter "GPC"), has a main peak within a molecular weight range from 1,000 to 10,000 and the half bandwidth of the main peak is 15,000 or less, it means that the absolute amount of low-molecular-weight contents in the toner is relatively large while the molecular weight distribution is sharp. Dissolving of the crystalline polyester resin (A) in non-chloroform-insoluble contents of the amorphous resin (B) is suppressed because the amount of the crystalline polyester resin (A) is low. The above molecular weight distribution helps improving low-temperature fixability of the crystalline polyester resin (A) without inhibiting hot offset resistance of the amorphous resin (B).

However, even when dissolving of the crystalline polyester resin (A) in non-chloroform-insoluble contents of the amorphous resin (B) is suppressed and deterioration of the glass transition temperature of these resins is suppressed, it is likely that the crystalline polyester resin (A) is frequently exposed at the surface of the toner in a case in which the crystalline polyester resin (A) is dispersed in the toner with a large dispersion diameter, regardless of the manufacturing method (e.g., pulverization method, polymerization method) of the toner. Heat-resistant storage stability of the toner is excellent when the crystalline polyester resin (A) is encapsulated in the toner. However, the crystalline polyester resin (A) being exposed at the surface of the toner is likely to melt slightly even at below the glass transition temperature and to bind multiple toner particles together, causing deterioration of heat-resistant storage stability of the toner. The higher the degree of crystallinity of the crystalline polyester resin (A), the greater the degree of deterioration of heat-resistant storage stability of the toner.

In addition, when the frequency of exposure of the crystalline polyester resin (A) at the surface of the toner is too high, it is likely that a thin film of the crystalline polyester resin (A) is undesirably formed on an organic photoreceptor during the image forming operations (this phenomenon is hereinafter "filming"), which results in deterioration of image quality.

Another problem may arise regarding electric properties of the toner. When the crystalline polyester resin (A) is dispersed in the toner with a large dispersion diameter, the electric resistivity of the toner is relatively low because the electric resistivity of the crystalline polyester resin (A) is relatively low. When the electric resistivity of the toner is too low, the toner is defectively transferred from one member onto another in the image forming processes. When dissolving of the crystalline polyester resin (A) in non-chloroform-insoluble contents of the amorphous resin (B) is suppressed, as described above, for keeping low-temperature fixability, the dispersion diameter of the crystalline polyester resin (A) is kept large and therefore the electric resistivity of the toner is dominated by that of the crystalline polyester resin (A) that is relatively low.

When the toner includes a resistivity controlling agent, to be described in detail later, the resistivity controlling agent is incorporated in not the domains of the crystalline polyester resin (A) but those of the other binder resins at a relatively high content, while optionally forming aggregates that undesirably decrease the electric resistivity of the toner. It is generally possible to adjust the electric resistivity of the toner by controlling the content of the resistivity controlling agent in the toner. However, in a case in which the resistivity controlling agent also functions as a colorant, such as a carbon black, it is impossible to reduce the content of the resistivity controlling agent only for the purpose of adjusting the electric resistivity of the toner.

According to an embodiment, the above-described problems, i.e., deterioration in heat-resistant storage stability and electric resistivity of the toner, arising from the combination use of the crystalline polyester resin (A) and the amorphous resin (B), can be solved by further combining the composite resin (C) having a condensation polymerization resin unit and an addition polymerization resin unit.

The composite resin (C) generally improves dispersibility of release agents in the toner. During the process of melting and kneading the crystalline polyester resin (A) and the amorphous resin (B), having a molecular weight distribution such that a main peak is observed within a molecular weight range from 1,000 to 10,000 and the half bandwidth of the main peak is 15,000 or less, the viscosity of the resins are lowered and the resins are applied with insufficient shearing force. As a result, the dispersion diameter of the crystalline polyester resin (A) in the toner gets large. By melting and kneading the crystalline polyester resin (A) and the amorphous resin (B) along with the composite resin (C), the resins are applied with sufficient shearing force and the crystalline polyester resin (A) can be finely dispersed in the toner.

When the crystalline polyester resin (A) is finely dispersed in the toner with a small dispersion diameter, the frequency of exposure of the crystalline polyester resin (A) at the surface of the toner is low. Such a toner has excellent heat-resistant storage stability and a proper electric resistivity.

The composite resin (C) is harder than the amorphous resin (B) that has a molecular weight distribution peak in a relatively low-molecular-weight region. Therefore, the composite resin (C) is much easier to pulverize and is more likely to be exposed at the surface of the toner. This means that the composite resin (C) is able to reduce the frequency of exposure of the amorphous resin (B) (amorphous resin (B-2)), having a relatively low softening temperature, at the surface of toner, contributing to improvement of heat-resistant storage stability of the toner.

In addition, the composite resin (C) enhances the hardness of the surface of the toner. Thus, the toner is less likely to deteriorate even under physical stresses. In particular, an external additive is prevented from being embedded in the toner even under physical stresses. Therefore, the charge property of the toner does not change before and after the exposure to physical stresses, and a certain degree of image quality is provided for an extended period of time.

Even when the crystalline polyester resin (A), amorphous resin (B), and composite resin (C) are used in combination, each of them may not exert their effects if the molecular chains thereof are cut and the molecular weights thereof are changed when they are melted and kneaded in the toner manufacturing process. In particular, when the molecular chains of the chloroform-insoluble contents included in the amorphous resin (B) are cut, undesirably, the molecular weight distribution of the toner is broadened and low-temperature fixability of the toner is deteriorated.

According to an embodiment, when the toner is manufactured through a process in which raw materials are melted and kneaded with application of a proper temperature and a proper shearing force and then the crystalline polyester resin (A) is recrystallized by cooling, the molecular weight distribution of the toner based on THF-soluble contents thereof, determined by GPC, has a main peak within a molecular weight range from 1,000 to 10,000 and the half bandwidth of the main peak is 15,000 or less, which means that the absolute amount of low-molecular-weight contents in the toner is relatively large while the molecular weight distribution is sharp. In this case, all the crystalline polyester resin (A), amorphous resin (B), and composite resin (C) can exert their effects and, as a result, the toner has a good combination of low-temperature fixability, heat-resistant storage stability, and hot offset resistance.

Whether or not the crystalline polyester resin (A) exerts its effect or by-effect largely depends on the amount of itself existing at the surface of the toner. Therefore, by optimizing the existence ratio of the crystalline polyester resin (A) at the surface of the toner by, for example, adjusting the content of the crystalline polyester resin (A) in the toner, the degree of dispersion of the crystalline polyester resin (A) by the action of the composite resin (C), and the melting and kneading conditions, the toner can provide a good combination of low-temperature fixability and heat-resistant storage stability while preventing the occurrence of filming problem on organic photoconductors (hereinafter "OPC").

The existence ratio of the crystalline polyester resin (A) at the surface of the toner is determined by a Fourier transform infrared spectroscopic attenuated total reflection method (hereinafter "FT-IR ATR method" or simply "ATR method"). In particular, the ratio (C/R) of the peak height (C) specific to the crystalline polyester resin (A) and the peak height (R) specific to the amorphous resin (B) is measured by the ATR method. Before the measurement, the toner is stored in a thermostatic chamber at 45° C. for 12 hours assuming that the toner is stored in high temperatures during transportation by ship. When the peak height ratio C/R is within a range from 0.03 to 0.55, the toner has a good combination of low-temperature fixability and heat-resistant storage stability and formation of an undesired film of the toner on organic photoreceptors (i.e., the filming) is prevented.

When the peak height ratio C/R exceeds 0.55, it means that an excessive amount of the crystalline polyester resin (A) exists at the surface of the toner, and therefore heat-resistant storage stability and filming resistance of the toner are poor. When the peak height ratio C/R is less than 0.03, it means that the amount of the crystalline polyester resin (A) existing at the surface of the toner is too small, and therefore low-temperature fixability of the toner is poor.

The existence ratio of the crystalline polyester resin (A) at the surface of the toner can be controlled by adjusting its content, degree of dispersion, method of kneading, etc. For example, C/R can be increased by increasing the content of the crystalline polyester resin (A) in the toner. As another example, C/R can be reduced by increasing the content of the composite resin (C) and improving the degree of dispersion in the toner. As another example, C/R can be increased by extending the cooling time period after the kneading process so that recrystallization is accelerated. The method for controlling C/R is not limited to the above-described methods so long as C/R gets within a range from 0.03 to 0.55.

More specifically, the peak height ratio C/R is determined from a spectrum obtained by an attenuation total reflection method ("ATR method") using a Fourier transform infrared spectrophotometer AVATAR 370 (available from Thermo Electron Corporation). Since the ATR method requires a measuring object have a smooth surface, 0.6 g of the toner is pelletized with a load of 1,000 kg for 30 seconds and formed into a pellet having a diameter of 20 mm.

FIG. 1 is an infrared absorption spectrum of a crystalline polyester resin according to an embodiment.

The crystalline polyester resin has a first minimum peak Fp1 at which the absorbance gets the smallest within a wavenumber range from 1,130 to 1,220 $cm^{-1}$; a second minimum peak Fp2 at which the absorbance gets the second smallest; and a maximum peak Mp at which the absorbance gets the largest between the first and second minimum peaks Fp1 and Fp2. In determining the height (C) of the maximum peak Mp, first, a baseline is drawn between the first and second minimum peaks Fp1 and Fp2. Next, a vertical line is drawn from the maximum peak Mp toward the horizontal axis. The absolute difference in absorbance between the maximum peak Mp and the intersection of the vertical line with the baseline is defined as the height C of the maximum peak Mp.

In the spectrum illustrated in FIG. 1, the wavenumbers at Fp1, Fp2, and Mp are 1,158 $cm^{-1}$, 1,201 $cm^{-1}$, and 1,183 $cm^{-1}$, respectively. (The baseline is drawn between 1,158 $cm^{-}$ and 1,201 $cm^{-1}$.)

Figure 2:
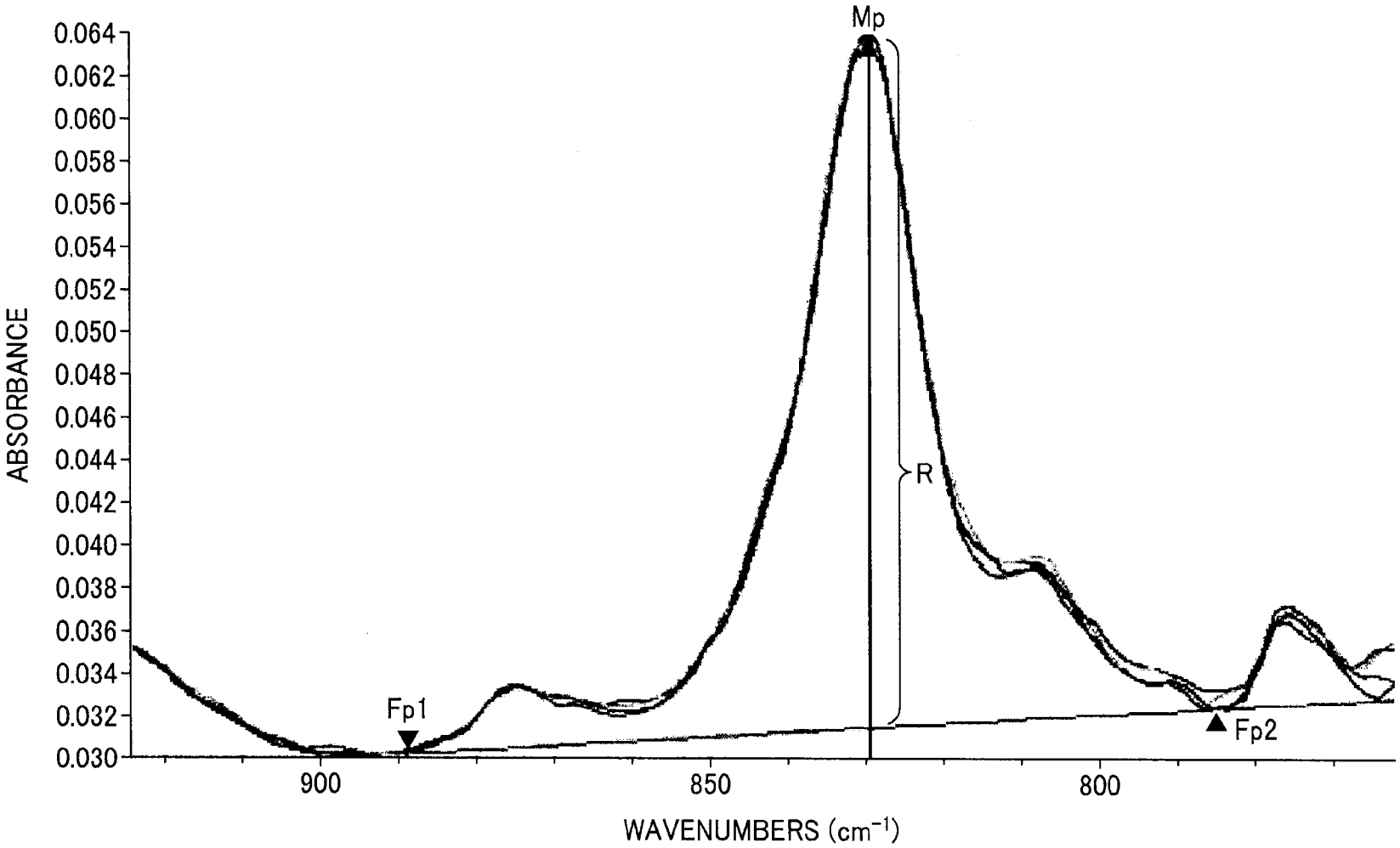
FIG. 2 is an infrared absorption spectrum of an amorphous polyester resin according to an embodiment.

FIG. 2 is an infrared absorption spectrum of an amorphous polyester resin according to an embodiment.

The amorphous polyester resin has a maximum peak Mp at which the absorbance gets the largest, a first minimum peak Fp1 at which the absorbance gets the smallest, and a second minimum peak Fp2 at which the absorbance gets the second smallest, each within a wavenumber range from 780 to 900 $cm^{-1}$. The maximum peak Mp is positioned between the first minimum peak Fp1 and the second minimum peak Fp2. In determining the height (R) of the maximum peak Mp, first, a baseline is drawn between the first and second minimum peaks Fp1 and Fp2. Next, a vertical line is drawn from the maximum peak Mp toward the horizontal axis. The absolute difference in absorbance between the maximum peak Mp and the intersection of the vertical line with the baseline is defined as the height (R) of the maximum peak Mp.

In the spectrum illustrated in FIG. 2, the wavenumbers at Fp1, Fp2, and Mp are 784 $cm^{-1}$, 889 $cm^{-1}$, and 829 $cm^{-1}$, respectively. (The baseline is drawn between 784 $cm^{-1}$ and 889 $cm^{-1}$.)

Figure 3:
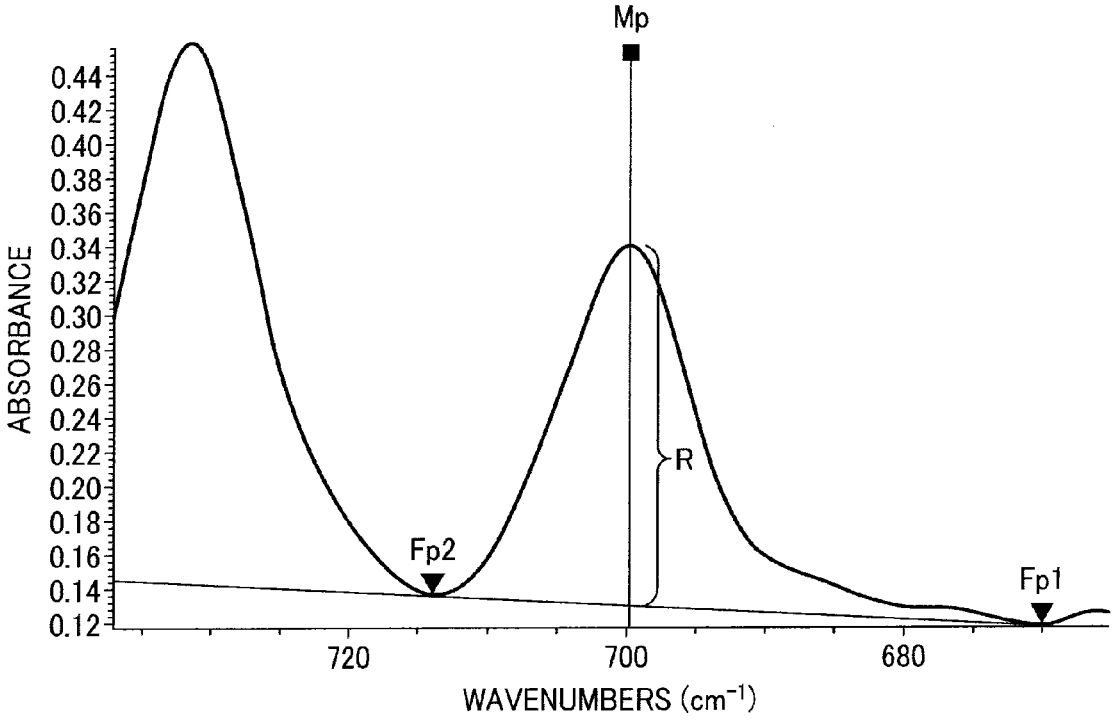
FIG. 3 is an infrared absorption spectrum of an amorphous styrene-acrylic resin according to an embodiment.

FIG. 3 is an infrared absorption spectrum of an amorphous styrene-acrylic resin according to an embodiment.

The amorphous polyester resin has a maximum peak Mp at which the absorbance gets the largest, a first minimum peak Fp1 at which the absorbance gets the smallest, and a second minimum peak Fp2 at which the absorbance gets the second smallest, each within a wavenumber range from 660 to 720 $cm^{-1}$. The maximum peak Mp is positioned between the first minimum peak Fp1 and the second minimum peak Fp2. In determining the height (R) of the maximum peak Mp, first, a baseline is drawn between the first and second minimum peaks Fp1 and Fp2. Next, a vertical line is drawn from the maximum peak Mp toward the horizontal axis. The absolute difference in absorbance between the maximum peak Mp and the intersection of the vertical line with the baseline is defined as the height (R) of the maximum peak Mp.

In the spectrum illustrated in FIG. 3, the wavenumbers at Fp1, Fp2, and Mp are 670 $cm^{-1}$, 714 $cm^{-1}$, and 699 $cm^{-1}$, respectively. (The baseline is drawn between 670 $cm^{-1}$ and 714 $cm^{-1}$.)

When the amorphous polyester resin and the amorphous styrene-acrylic resin are used in combination, the heights (R) determined from the their maximum peaks Mp within each ranges from 780 to 900 $cm^{-1}$ and 660 to 720 $cm^{-1}$, respectively, are compared, and the larger one is employed as the height (R) for calculating C/R.

In some embodiments, the content of the crystalline polyester resin (A) in the toner is from 1 to 15% by weight of the toner, or from 1 to 10% by weight of the toner. In some embodiments, the content of an amorphous resin (B-1) (to be described in detail later) is from 10 to 40% by weight of the toner, the content of an amorphous resin (B-2) (to be described in detail later) is from 50 to 90% by weight of the toner, and the content of the composite resin (C) is from 3 to 20% by weight of the toner.

The measurement procedure of gel permeation chromatography (GPC) is described below.

First, stabilize columns in a heat chamber at 40° C. and flow THF (i.e., solvent) therein at a flow rate of 1 ml/min. Inject 50 to 200 μl of a sample THF solution containing 0.05 to 0.6% by weight of a sample (i.e., resin).

Molecular weight of the sample is determined from the resulting molecular weight distribution with reference to a calibration curve compiled from several kinds of monodisperse polystyrene standard samples.

The calibration curve may be complied from, for example, at least 10 polystyrene standard samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, available from Pressure Chemical Company or Tosoh Corporation. A refractive index detector can be used as a detector.

In some embodiments, the amorphous resin (B) includes an amorphous resin (B-1) and an amorphous resin (B-2). A softening temperature (T1/2) of the amorphous resin (B-2) is 25° C. or more lower than that of the amorphous resin (B-1). When the amorphous resin (B-1) and the amorphous resin (B-2) are used in combination, dissolving of the crystalline polyester resin (A) in non-chloroform-insoluble contents of the amorphous resin (B) is suppressed because the amount of the crystalline polyester resin (A) is low. The amorphous resin (B-2) helps improving low-temperature fixability of the crystalline polyester resin (A) without adversely affecting the hot offset resistance originated from chloroform-insoluble contents of the amorphous resin (B-1).

The softening temperature (T1/2) is measured with an instrument FLOWTESTER CFT-500 (from Shimadzu Corporation) by melting and flowing a sample having an area of 1 $cm^2$ while setting the die orifice diameter to 1 mm, the pressure to 20 $kg/cm^2$, and the heating speed to 6° C./min. The softening temperature (T1/2) is defined as a temperature at the midpoint between the flow starting point and the flow end point.

In some embodiments, the crystalline polyester resin (A) has an ester bond represented by the following formula (I):

$$[\text{—OCO—R—COO—}(CH_2)_n\text{—}] \quad (I)$$

wherein R represents a straight-chain unsaturated aliphatic dicarboxylic acid residue having a carbon number of from 2 to 20, and n represents an integer of from 2 to 20.

Whether the ester bond having the formula (I) exists or not can be determined by solid $C^{13}$ NMR.

The straight-chain unsaturated aliphatic group may be originated from, for example, straight-chain unsaturated dicarboxylic acids such as maleic acid, fumaric acid, 1,3-n-propenedicarboxylic acid, and 1,4-n-butenedicarboxylic acid.

In the formula (I), $(CH_2)_n$ represents a straight-chain aliphatic diol residue. The straight-chain aliphatic divalent alcohol residue may be originated from, for example, straight-chain aliphatic divalent alcohols such as ethylene glycol, 1,3-propylene glycol, 1,4-butanediol, and 1,6-hexanediol.

A polyester resin that is obtained from a straight-chain unsaturated aliphatic dicarboxylic acid is more likely to form a crystalline structure compared to that obtained from an aromatic dicarboxylic acid.

The crystalline polyester resin (A) can be obtained from, for example, a polycondensation reaction between (i) a polycarboxylic acid component comprised of a straight-chain unsaturated aliphatic dicarboxylic acid or a reactive derivative thereof (e.g., an acid anhydride, a lower alkyl ester having 1 to 4 carbon atoms, an acid halide) and (ii) a polyol component comprised of a straight-chain aliphatic diol. The polycarboxylic acid component may further comprise a small amount of another polycarboxylic acid, if needed.

The polycarboxylic acid which can be included in the polycarboxylic acid component may be, for example, (i) unsaturated aliphatic dicarboxylic acids having a branched chain, (ii) saturated aliphatic polycarboxylic acids (e.g., saturated aliphatic dicarboxylic acids, saturated aliphatic tricarboxylic acids), and (iii) aromatic polycarboxylic acids (e.g., aromatic dicarboxylic acids, aromatic tricarboxylic acids).

In some embodiments, the content of the polycarboxylic acid is 30% by mol or less, or 10% by mol or less, based on total carboxylic acids, within which the resulting polyester resin is given crystallinity.

Specific examples of the polyvalent carboxylic acids which can be included in the polycarboxylic acid component include, but are not limited to, dicarboxylic acids (e.g., malonic acid, succinic acid, glutaric acid, adipic acid, suberic acid, sebacic acid, citraconic acid, phthalic acid, isophthalic acid, terephthalic acid) and tri- or more valent carboxylic acids (e.g., trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, 1,2,7,8-octanetetracarboxylic acid).

The polyol component may further comprise a small amount of another polyol, such as an aliphatic branched-chain diol, a cyclic diol, and a tri- or more valent polyol.

In some embodiments, the content of the polyol is 30% by mol or less, or 10% by mol or less, based on total alcohols, within which the resulting polyester resin is given crystallinity.

Specific examples of the polyols which can be included in the polyol component include, but are not limited to, 1,4-bis (hydroxymethyl)cyclohexane, polyethylene glycol, ethylene oxide adduct of bisphenol A, propylene oxide adduct of bisphenol A, and glycerin.

In some embodiments, the crystalline polyester resin (A) has a narrow molecular weight distribution and a low molecular weight to improve low-temperature fixability of the toner.

In some embodiments, the weight average molecular weight (Mw), number average molecular weight (Mn), and the ratio (Mw/Mn) of the crystalline polyester resin (A) measured based on its o-dichlorobenzene-soluble contents are from 5,500 to 6,500, from 1,300 to 1,500, and from 2 to 5, respectively.

The molecular weight distribution chart has a lateral axis being "log M" (M represents molecular weight) scale and a vertical axis being "% by weight" scale. In some embodiments, the molecular weight distribution chart of the crystalline polyester resin (A) has a peak within a range of from 3.5 to 4.0% by weight and the half bandwidth of the peak is 1.5 or less.

The glass transition temperature (Tg) and the softening temperature (T1/2) of the crystalline polyester resin (A) are preferably as low as possible so long as heat-resistant storage stability does not deteriorate. In some embodiments, Tg is from 80 to 130° C., or 80 to 125° C.; and a softening temperature (T1/2) is from 80 to 130° C., or 80 to 125° C. When Tg and T1/2 are beyond the above range, low-temperature fixability of the toner may be poor. When Tg and T1/2 are beyond the above range, heat-resistant storage stability of the toner may be poor.

Whether the crystalline polyester resin (A) has crystallinity or not can be determined by determining whether an X-ray diffraction pattern thereof has a peak or not.

In some embodiments, the X-ray diffraction pattern of the crystalline polyester resin (A) has at least one peak within a 2θ range of from 19° to 25°. In some embodiments, the X-ray diffraction pattern of the crystalline polyester resin (A) has peaks within a 2θ range of (i) from 19° to 20°, (ii) from 21° to 22°, (iii) from 23° to 25°, and (iv) from 29° to 31°. When the X-ray diffraction pattern of the resulting toner has a peak within a 2θ range of from 19° to 25°, it means that the crystallinity of the crystalline polyester resin (A) is maintained in the toner and therefore the crystalline polyester resin (A) can satisfactorily exert its effect.

X-ray diffraction patterns can be obtained with an instrument RINT 1100 (available from Rigaku Corporation) equipped with a Cu tube. In the measurement, the tube voltage and current are set to 50 kV and 30 mA, respectively, and a wide-angle goniometer is used.

Figure 4:
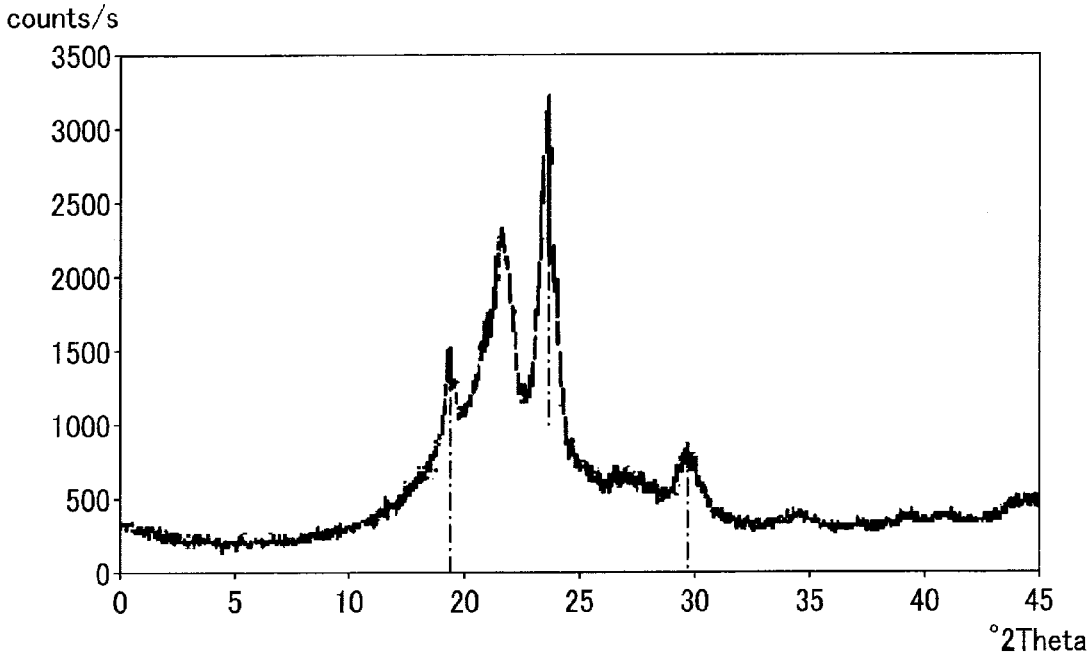
FIG. 4 is a graph showing an X-ray diffraction pattern of a crystalline polyester resin according to an embodiment.
Figure 5:
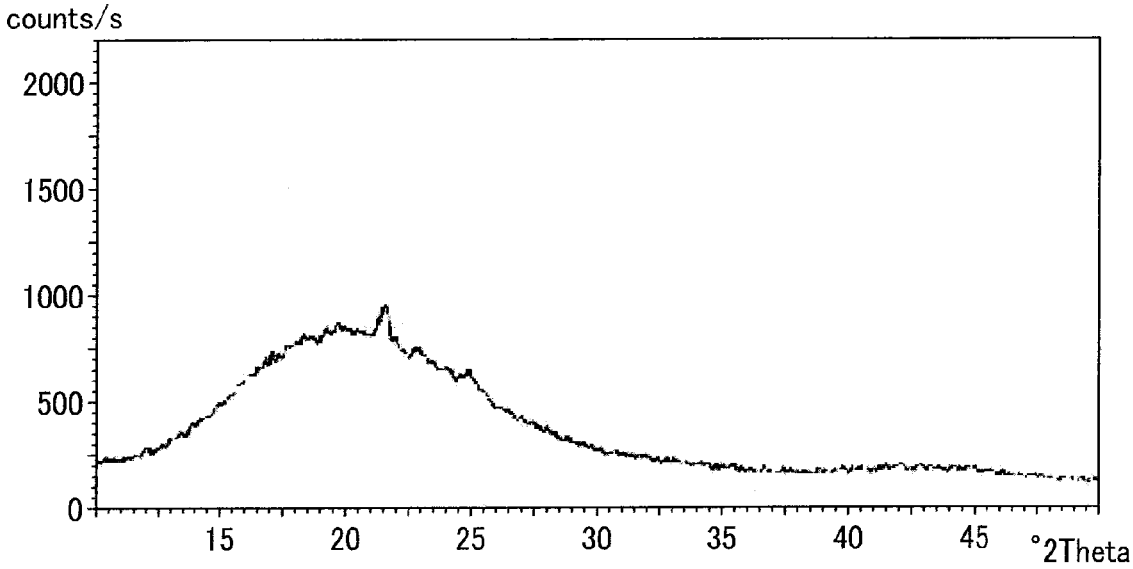
FIG. 5 is a graph showing an X-ray diffraction pattern of a toner according to an embodiment.

FIG. 4 is a graph showing an X-ray diffraction pattern of a crystalline polyester resin a6 (to be described in later) according to an embodiment. FIG. 5 is a graph showing an X-ray diffraction pattern of a toner of Example 30 (to be described in later) according to an embodiment.

According to some embodiments, the amorphous resin (B) includes chloroform-insoluble contents. In some embodiments, the amorphous resin (B) includes the amorphous resin (B-1) and the amorphous resin (B-2) and the amorphous resin (B-1) includes chloroform-insoluble contents. When the amorphous resin (B-1) includes chloroform-insoluble contents in an amount of from 5 to 40% by weight, the toner readily expresses hot offset resistance. When the toner is prepared such that chloroform-insoluble contents in an amount of from 1 to 30% by weight, or 2 to 20% by weight, are included, hot offset resistance is maintained and the amount of the resins other than the amorphous resin (B-1) is secured. When the amount of chloroform-insoluble contents in the toner falls below 1% by weight, hot offset resistance of the toner deteriorates. When the amount of chloroform-insoluble contents in the toner exceeds 30% by weight, low-temperature fixability of the toner deteriorates.

The amount of chloroform-insoluble contents is measured as follows.

Weigh about 1.0 g of a sample (e.g., toner, resin) and add about 50 g of chloroform thereto. After sufficiently dissolving the sample in the chloroform, subject the solution to centrifugal separation and then to filtration at normal temperatures using a quantitative filter paper according to JIS standard (P3801) 5C. The residue remaining on the filter paper is chloroform-insoluble contents. Thus, the quantity of chloroform-insoluble contents is determined from the ratio (% by weight) of the weight of the residue and the initial weight of the sample.

In a case in which the sample is a toner, the residue remaining on the filter paper contains solid contents other than the binder resins, such as pigments. Such effects of the other solid contents can be removed by thermal analysis.

In some embodiments, the softening temperature (T1/2) of the amorphous resin (B-2) is 25° C. or more lower than that of the amorphous resin (B-1). In such embodiments, the amorphous resin (B-1) and the amorphous resin (B-2) are clearly separated from each other in terms of their functions. The amorphous resin (B-2) contributes to improvement of low-temperature fixability of the crystalline polyester resin (A), while the amorphous resin (B-1) contributes to improvement of hot offset resistance by inclusion of chloroform-insoluble contents.

In some embodiments, a molecular weight distribution of the amorphous resin (B-2) based on THF-soluble contents thereof, determined by gel permeation chromatography, has a main peak within a molecular weight range from 1,000 to 10,000 and a half bandwidth of the main peak is 15,000 or less. In such embodiments, the amorphous resin (B-2) expresses excellent low-temperature fixability. Therefore, even if the content of the crystalline polyester resin (A) in the toner is reduced, the toner can express low-temperature fixability. When a molecular weight distribution of the toner based on THF-soluble contents thereof has a main peak within a molecular weight range from 1,000 to 10,000 and a half bandwidth of the main peak is 15,000 or less, even when the amorphous resin (B-2) having the above-described molecular weight distribution is included in the toner, it means that the ratio of the amorphous resin (B-2) in the toner is relatively high. In cases in which the crystalline polyester resin (A), amorphous resin (B-1), amorphous resin (B-2), and composite resin (C) are used in combination, properties of the resulting toner can be well balanced by increasing the ratio of the amorphous resin (B-2). In such cases, no side effects are produced by excessive crystalline polyester resin or THF-insoluble contents and the composite resin (C) does not cause deterioration of low-temperature fixability, providing a toner with a good combination of low-temperature fixability, heat-resistant storage stability, and hot offset resistance.

Thus, according to an embodiment, a molecular weight distribution of the toner based on THF-soluble contents thereof, determined by gel permeation chromatography, has a main peak within a molecular weight range from 1,000 to 10,000 and a half bandwidth of the main peak is 15,000 or less.

According to some embodiments, the toner includes the amorphous resin (B-1) including chloroform-insoluble contents and the amorphous resin (B-2) having a proper molecular weight distribution, both of which has a proper softening temperature as described above. Specific examples of the amorphous resin (B-1) and amorphous resin (B-2) are listed below, but are not limited thereto. These resins can be used alone or in combination.

Polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer, styrene-phenyl acrylate copolymer), styrene-methacrylate copolymers (e.g., styrene-methyl methacrylate copolymer, styrene-ethyl methacrylate copolymer, styrene-butyl methacrylate copolymer, styrene-phenyl methacrylate copolymer), styrene-based resins (i.e., homopolymers and copolymers of styrene or styrene derivatives) such as styrene-methyl α-chloroacrylate copolymer and styrene-acrylonitrile-acrylate copolymer, and petroleum or hydrogenated petroleum resins such as vinyl chloride resin, styrene-vinyl acetate resin, rosin-modified maleic acid resin, phenol resin, epoxy resin, polyethylene resin, polypropylene resin, ionomer resin, polyurethane resin, silicone resin, ketone resin, ethylene-ethyl acrylate copolymer, xylene resin, and polyvinyl butyral resin.

These resins are not limited in production process and are obtainable by bulk polymerization, solution polymerization, emulsion polymerization, suspension polymerization, etc.

According to some embodiments, the amorphous resin (B) is a polyester resin in view of low-temperature fixability. For example, a polyester resin obtained from a polycondensation reaction between an alcohol and a carboxylic acid can be used.

Specific examples of usable alcohols include, but are not limited to, glycols (e.g., ethylene glycol, diethylene glycol, triethylene glycol, propylene glycol), etherified bisphenols (e.g., 1,4-bis(hydroxymethyl)cyclohexane, bisphenol A), divalent alcohols, and tri- or more valent polyols.

Specific examples of usable carboxylic acids include, but are not limited to, divalent organic acids (e.g., maleic acid, fumaric acid, phthalic acid, isophthalic acid, terephthalic acid, succinic acid, malonic acid) and tri- or more valent polycarboxylic acids (e.g., 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, 1,2,7,8-octanetetracarboxylic acid).

In some embodiments, the polyester resin has a glass transition temperature (Tg) of 55° C. or more, or 60° C. or more, in view of heat-resistant storage stability.

The composite resin (C) is a resin in which a condensation polymerizable monomer and an addition polymerizable monomer are chemically bonded. (The composite resin (C) may be hereinafter referred to as a hybrid resin.)

Thus, the composite resin (C) has a condensation polymerization resin unit and an addition polymerization resin unit.

The composite resin (C) is obtainable by subjecting a mixture of a condensation polymerizable monomer and an addition polymerizable monomer to a condensation polymerization and an addition polymerization in a single reaction vessel at the same time or in a sequential manner. As a result, the composite resin (C) having a condensation polymerization resin unit and an addition polymerization resin unit is obtained.

The condensation polymerizable monomer may be comprised of, for example, a combination of a polyol and a polycarboxylic acid that produces a polyester resin unit; or a combination of a polycarboxylic acid, an amine, and an amino acid that produces a polyamide resin unit or a polyester-polyamide resin unit.

Specific examples of usable divalent alcohols include, but are not limited to, 1,2-propanediol, 1,3-propanediol, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtainable by polymerizing bisphenol A with a cyclic ether such as ethylene oxide or propylene oxide.

Specific examples of usable tri- or more valent alcohols include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

In particular, alcohols having a bisphenol A skeleton, such as diols obtainable by polymerizing hydrogenated bisphenol A or bisphenol A with a cyclic ether such as ethylene oxide or propylene oxide, are advantageous in giving heat-resistant storage stability and mechanical strength to the resin.

Specific examples of usable carboxylic acids include, but are not limited to, benzenedicarboxylic acids (e.g., phthalic acid, isophthalic acid, terephthalic acid) and anhydrides thereof; alkyl dicarboxylic acids (e.g., succinic acid, adipic acid, sebacic acid, azelaic acid) and anhydrides thereof; and unsaturated dibasic acids (e.g., maleic acid, citraconic acid, itaconic acid, alkenyl succinic acid, fumaric acid, mesaconic acid) and anhydrides thereof.

Specific examples of usable polycarboxylic acids having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,7,8-octanetetracarboxylic acid, and enpol trimmer acid; and anhydrides or partial lower alkyl esters thereof.

In particular, aromatic polycarboxylic acids such as phthalic acid, isophthalic acid, terephthalic acid, and trimellitic acid are advantageous in terms of giving heat-resistant storage stability and mechanical strength to the resin.

The amine or amino acid may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid, aminocaproic acid, and ϵ-caprolactam.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

In some embodiments, the molar ratio of the contents originated from the condensation polymerizable monomer in the composite resin (C) is from 5 to 40% by mole, or from 10 to 25% by mole.

When the molar ratio falls below 5%, dispersibility of the composite resin (C) with polyester-based resins may deteriorate. When the molar ratio exceeds 50%, dispersibility of release agents with the composite resin (C) may deteriorate.

In the condensation polymerization, an esterification catalyst can be used.

The addition polymerizable monomer may be comprised of, for example, vinyl monomers.

Specific examples of usable vinyl monomers include, but are not limited to, styrene-based vinyl monomers (e.g., styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene, o-nitrostyrene); acrylic monomers (e.g., acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, phenyl acrylate); and methacrylic monomers (e.g., methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, diethylaminoethyl methacrylate).

Additionally, the following monomers are also usable: monoolefins (e.g., ethylene, propylene, butylene, isobutylene); polyenes (e.g., butadiene, isoprene); vinyl halides (e.g., vinyl chloride, vinylidene chloride, vinyl bromide, vinyl fluoride); vinyl esters (e.g., vinyl acetate, vinyl propionate, vinyl benzoate); vinyl ethers (e.g., vinyl methyl ether, vinyl ethyl ether, vinyl isobutyl ether); vinyl ketones (e.g., vinyl methyl ketone, vinyl hexyl ketone, methyl isopropenyl ketone); N-vinyl compounds (e.g., N-vinyl pyrrole, N-vinyl carbazole, N-vinyl indole, N-vinyl pyrrolidone); vinylnaphthalenes; acrylic or methacrylic acid derivatives (e.g., acrylonitrile, methacrylonitrile, acrylamide); unsaturated dibasic acids (e.g., maleic acid, citraconic acid, itaconic acid, alkenyl succinic acid, fumaric acid, mesaconic acid); unsaturated dibasic acid anhydrides (e.g., maleic acid anhydride, citraconic acid anhydride, itaconic acid anhydride, alkenyl succinic acid anhydride); unsaturated dibasic acid monoesters (e.g., maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, mesaconic acid monomethyl ester); unsaturated dibasic acid esters (e.g., dimethyl maleic acid, dimethyl fumaric acid); α,β-unsaturated acids (e.g., crotonic acid, cinnamic acid); α,β-unsaturated acid anhydrides (e.g., crotonic acid anhydride, cinnamic acid anhydride); carboxyl-group-containing monomers (e.g., anhydrides of α,β-unsaturated acids and lower aliphatic acids, alkenyl malonic acid, alkenyl glutaric acid, alkenyl adipic acid, and acid anhydrides or monoesters thereof); and hydroxyl-group containing monomers (e.g., acrylic or methacrylic acid hydroxyalkyl esters such as 2-hydroxyethyl acrylate, 2-hydroxyethyl methacrylate, 2-hydroxypropyl methacrylate, 4-(1-hydroxy-1-methylbutyl)styrene, 4-(1-hydroxy-1-methylhexyl)styrene).

In some embodiments, styrene, acrylic acid, n-butyl acrylate, 2-ethylhexyl acrylate, methacrylic acid, n-butyl methacrylate, or 2-ethylhexyl methacrylate is used. In particular, a combination of styrene and acrylic acid is advantageous in view of dispersibility of release agents.

The addition polymerizable monomer can be use in combination with a cross-linking agent, if needed.

Specific materials usable as the cross-linking agent include, but are not limited to, aromatic divinyl compounds such as divinylbenzene and divinylnaphthalene.

Specific materials usable as the cross-linking agent further include, but are not limited to, diacrylate compounds in which acrylates are bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate; and dimethacrylate compounds in which methacrylates are bonded with an alkyl chain, such as ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate.

Specific materials usable as the cross-linking agent further include, but are not limited to, diacrylate compounds in which acrylates are bonded with an alkyl chain having an ether bond, such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate; and dimethacrylate compounds in which methacrylates are bonded with an alkyl group having an ether bond, such as diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate.

Diacrylate and dimethacrylate compounds in which acrylates and methacrylates, respectively, are bonded with a chain having an aromatic group and an ether bond are also usable.

A commercially-available polyester-based diacrylate MANDA (from Nippon Kayaku Co., Ltd) is also usable as the cross-linking agent.

Additionally, polyfunctional cross-linking agents are also usable, such as pentaerythritol triacrylate, trimethylolethane triacrylate, trimethylolpropane triacrylate, tetramethylolmethane tetraacrylate, oligo ester acrylate, pentaerythritol trimethacrylate, trimethylolethane trimethacrylate, trimethylolpropane trimethacrylate, tetramethylolmethane tetramethacrylate, oligo ester methacrylate, triallyl cyanurate, and triallyl trimellitate.

In some embodiments, the amount of the cross-linking agent is from 0.01 to 10 parts by weight or from 0.03 to 5 parts by weight, based on 100 parts by weight of the addition polymerizable monomer.

Specific examples of usable polymerization initiators in polymerizing the addition polymerizable polymer include, but are not limited to, azo initiators (e.g., 2,2'-azobis isobutyronitrile, 2,2'-azobis(4-methoxy-2,4-dimethylvaleronitrile), 2,2'-azobis(2,4-dimethylvaleronitrile)); and peroxide initiators (e.g., methyl ethyl ketone peroxide, acetyl acetone peroxide, 2,2-bis(tert-butylperoxy)butane, tert-butyl hydroperoxide, benzoyl peroxide, n-butyl-4,4-di-(tert-butylperoxy) valerate).

Two or more of these initiators can be used in combination for controlling molecular weight or molecular weight distribution of the resulting resin.

In some embodiments, the amount of the polymerization initiator is from 0.01 to 15 parts by weight or from 0.1 to 10 parts by weight, based on 100 parts by weight of the addition polymerizable monomer.

To form the condensation polymerization resin unit and the addition polymerization resin unit chemically bonded, monomers capable of both condensation polymerizing and addition polymerizing are used.

Specific examples of such monomers include, but are not limited to, unsaturated carboxylic acids (e.g., acrylic acid, methacrylic acid); unsaturated dicarboxylic acids (e.g., fumaric acid, maleic acid, citraconic acid, itaconic acid) and anhydrides thereof; and hydroxyl-group-containing vinyl monomers.

In some embodiments, the amount of the such monomer is from 1 to 25 parts by weight or from 2 to 20 parts by weight, based on 100 parts by weight of the addition polymerizable monomer.

In preparing the composite resin (C), a condensation polymerization and an addition polymerization are performed and/or terminated simultaneously, or alternatively, independently at respective reaction temperatures and reaction times, so long as the reactions are performed in a single reaction vessel.

For example, one possible reaction procedure includes charging a reaction vessel with a mixture including a condensation polymerizable monomer, dropping a mixture including an addition polymerizable monomer and a polymerization initiator in the reaction vessel, inducing a radical polymerization to complete an addition polymerization first, and increasing the reaction temperature to initiate a condensation polymerization.

By performing two independent polymerization reactions in a single reaction vessel as described above, the two kinds of resin units are effectively dispersed or bonded with each other.

In some embodiments, the condensation polymerization resin unit and the addition polymerization resin unit of the composite resin (C) are a polyester resin unit and a vinyl resin unit, respectively.

In some embodiments, the composite resin (C) has a softening temperature (T1/2) of from 90 to 130° C., or from 100 to 120° C.

When the softening temperature (T1/2) falls below 90° C., heat-resistant storage stability and offset resistance may deteriorate. When the softening temperature (T1/2) exceeds 130° C., low-temperature fixability may deteriorate.

In some embodiments, the composite resin (C) has a glass transition temperature (Tg) of from 45 to 80° C., from 50 to 70° C., or from 53 to 65° C., in view of fixability, storage stability, and durability of the toner.

In some embodiments, the composite resin (C) has an acid value of from 5 to 80 mgKOH/g, or from 15 to 40 mgKOH/g.

According to an embodiment, the toner includes a charge controlling agent.

Specific examples of usable charge controlling agents include, but are not limited to, nigrosine and denatured products (e.g., a fatty acid metal salt), onium salts (e.g., a phosphonium salt), and lake pigments thereof; triphenylmethane dyes, and lake pigments and higher fatty acid metal salts thereof; diorganotin oxides (e.g., dibutyltin oxide, dioctyltin oxide, dicyclohexyltin oxide); diorganotin borates (e.g., dibutyltin borate, dioctyltin borate, dicyclohexyltin borate); organic metal complexes; chelate compounds; monoazo metal complexes; acetylacetone metal complexes; aromatic hydroxycarboxylic acid metal complexes; aromatic dicarboxylic acid metal complexes; quaternary ammonium salts; and salicylic acid metal compounds. Specific examples of usable charge controlling agents further include, but are not limited to, aromatic hydroxycarboxylic acids and aromatic mono- and poly-carboxylic acids, and metal salts, anhydrides, and esters thereof; and phenol derivatives such as bisphenol.

In some embodiments, the content of the charge controlling agent is from 0.1 to 10 parts by weight, or from 1 to 5 parts by weight, based on total weight of resins in the toner.

Among the above compounds, salicylic acid metal compounds are advantageous in improving hot offset resistance. In particular, a complex containing a trivalent or more valent metal capable of forming a six-coordinate complex is advantageous in improving hot offset resistance because such a complex is reactive with highly-reactive portions of resins and waxes to form a weak cross-linking structure. Additionally, when used in combination with the composite resin (C), dispersibility of such a complex in the toner is improved and the complex can sufficiently exert its charging ability.

The trivalent or more valent metal may be, for example, Al, Fe, Cr, or Zr.

The salicylic acid metal compound may be represented as the following formula. This metal complex containing zinc as M is available as a product name BONTRON® E-84 from Orient Chemical Industries Co., Ltd.

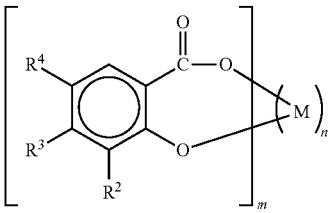

wherein each of $R^2$, $R^3$, and $R^2$ independently represents a hydrogen atom, a straight-chain or branched-chain alkyl group having a carbon number of from 1 to 10, or an alkenyl group having a carbon number of from 2 to 10; M represents chromium, zinc, calcium, zirconium, or aluminum; m represents an integer of 2 or more; and n represents an integer of 1 or more.

According to an embodiment, the toner has an endothermic peak originated from the crystalline polyester resin (A) within a temperature range from 90 to 130° C., which is determined by a differential scanning calorimetry (DSC). When the endothermic peak originated from the crystalline polyester resin (A) is present within a temperature range from 90 to 130° C., the crystalline polyester resin (A) does not melt at normal temperatures, but the toner is meltable and fixable on a recording medium at relatively lower temperatures. Thus, the toner can express heat-resistant storage stability and low-temperature fixability.

In some embodiments, the endothermic quantity of the endothermic peak is within a range from 1 to 15 J/g.

When the endothermic quantity is less than 1 J/g, it means that the effective amount of the crystalline polyester resin in the toner is too small and the crystalline polyester resin cannot exert its effect. When the endothermic quantity exceeds 15 J/g, it means that the effective amount of the crystalline polyester is too large. In this case, the absolute amount of the crystalline polyester which dissolves in the amorphous polyester resin is too large and therefore the glass transition temperature of the toner is lowered and heat-resistant storage stability of the toner is degraded.

Endothermic peaks and glass transition temperatures (Tg) are measured with a differential scanning calorimeter DSC-60 (available from Shimadzu Corporation) with heating a sample from 20 to 150° C. at a heating rate of 10° C./min.

According to an embodiment, the endothermic peak originated from the crystalline polyester resin is present within a temperature range from 90 to 130° C. that is equivalent to the melting point of the crystalline polyester resin. The endothermic quantity is determined from the area bounded by the baseline and endothermic curve. Generally, in DSC measurement procedures, the endothermic quantity is measured by heating a sample twice to obtain first and second endothermic curves. In the present embodiment, endothermic peaks and glass transition temperatures are determined from the first endothermic curve obtained in the first heating.

In a case in which the endothermic peak originated from the crystalline polyester resin (A) is overlapped with that originated from a wax, the endothermic quantity originated from the wax is reduced from that of the overlapped peak. The endothermic quantity originated from the wax is measured from the endothermic quantity measured from the wax alone and the content of the wax in the toner.

According to an embodiment, the toner includes a fatty acid amide compound.

In a case in which the toner is produced through a process in which the crystalline polyester resin (A) are melted and kneaded together with a fatty acid amide compound, the fatty acid amide compound accelerates recrystallization of the crystalline polyester resin (A) when being cooled. Thus, dissolving of the crystalline polyester resin (A) in other resins is suppressed and therefore lowering of the glass transition temperature of the toner is prevented. The toner provides an improved heat-resistant storage stability. In a case in which the fatty acid amide compound is used in combination with a release agent, the fatty acid amide compound makes the release agent remain on a fixed toner image. Thus, the toner image gets resistant to rubbing or smear.

In some embodiments, the content of the fatty acid amide compound in the toner is within a range from 0.5 to 10% by weight.

According to an embodiment, the fatty acid amide compound is represented by the formula $R^{10}$—CO—$NR^{12}R^{13}$.

$R^{10}$ represents an aliphatic hydrocarbon group having a carbon number of from 10 to 30, and each of $R^{12}$ and $R^{13}$ independently represents a hydrogen atom, an alkyl group having a carbon number of from 1 to 10, an aryl group having a carbon number of from 6 to 10, or an aralkyl group having a carbon number of from 7 to 10. The alkyl, aryl, aralkyl groups for $R^{12}$ and $R^{13}$ may be substituted with an inert group such as a fluorine atom, a chloride atom, a cyano group, an alkoxy group, or an alkylthio group. Preferably, these groups are not substituted.

Specific examples of usable fatty acid amide compounds include, but are not limited to, stearic acid amide, stearic acid methylamide, stearic acid diethylamide, stearic acid benzylamide, stearic acid phenylamide, behenic acid amide, behenic acid dimethylamide, myristic acid amide, and palmitic acid amide.

In some embodiments, an alkylenebis fatty acid amide represented by the following formula (II) is used:

$$R^{14}—CO—NH—R^{15}—NH—CO—R^{16} \quad (II)$$

wherein each of $R^{14}$ and $R^{16}$ independently represents an alkyl or alkenyl group having a carbon number of from 5 to 21 and $R^{15}$ represents an alkylene group having a carbon number of from 1 to 20.

Specific examples of the alkylenebis saturated fatty acid amide represented by the formula (II) include, but are not limited to, methylenebis stearic acid amide, ethylenebis stearic acid amide, methylenebis palmitic acid amide, ethylenebis palmitic acid amide, methylenebis behenic acid amide, ethylenebis behenic acid amide, hexamethylenebis stearic acid amide, hexaethylenebis palmitic acid amide, and hexamethylenebis behenic acid amide. In some embodiments, ethylenebis stearic acid amide is preferred.

The fatty acid amide compound is capable of functioning as a release agent at a surface of a fixing member when the softening temperature (T1/2) is lower than the surface temperature of the fixing member during fixing operation.

Specific examples of the alkylenebis fatty acid amide further include, but are not limited to, saturated or unsaturated monovalent or divalent alkylenebis fatty acid amide compounds such as propylenebis stearic acid amide, butylenebis stearic acid amide, methylenebis oleic acid amide, ethylenebis oleic acid amide, propylenebis oleic acid amide, butylenebis oleic acid amide, methylenebis lauric acid amide, ethylenebis lauric acid amide, propylenebis lauric acid amide, butylenebis lauric acid amide, methylenebis myristic acid amide, ethylenebis myristic acid amide, propylenebis myristic acid amide, butylenebis myristic acid amide, propylenebis palmitic acid amide, butylenebis palmitic acid amide, methylenebis palmitoleic acid amide, ethylenebis palmitoleic acid amide, propylenebis palmitoleic acid amide, butylenebis palmitoleic acid amide, methylenebis arachidic acid amide, ethylenebis arachidic acid amide, propylenebis arachidic acid amide, butylenebis arachidic acid amide, methylenebis eicosenoic acid amide, ethylenebis eicosenoic acid amide, propylenebis eicosenoic acid amide, butylenebis eicosenoic acid amide, methylenebis behenic acid amide, ethylenebis behenic acid amide, propylenebis behenic acid amide, butylenebis behenic acid amide, methylenebis erucic acid amide, ethylenebis erucic acid amide, propylenebis erucic acid amide, and butylenebis erucic acid amide.

Specific examples of usable colorants include, but are not limited to, carbon black, lamp black, iron black, Aniline Blue, Phthalocyanine Blue, Phthalocyanine Green, Hansa Yellow Cx Rhodamine 6C Lake, Calco Oil Blue, Chrome Yellow, Quinacridone, Benzidine Yellow, Rose Bengal, and triarylmethane dyes. Two or more of such colorants can be used in combination. The toner may be either a black toner for single-color printing or a colored toner for full-color printing.

Carbon black has an excellent black coloring power. On the other hand, carbon black is a conductive material. Therefore, if the content of carbon black in the toner is too large or aggregates of carbon black are contained in the toner, electric resistivity of the toner is lowered and the toner may be defectively transferred from one member to another. Additionally, carbon black cannot be incorporated into domains of the crystalline polyester resin (A). Thus, when the domains of the crystalline polyester resin (A) are relatively large, carbon black is dispersed in the resins other than the crystalline polyester resin (A) at a relatively high concentration. As a result, it is likely that aggregates of carbon black are contained in the toner and electric resistivity of the toner is excessively lowered.

According to an embodiment, the above problem in dispersing carbon black can be solved by using the composite resin (C). In a case in which the toner includes carbon black, the viscosity of the toner is increased when the toner is melted and fixed on a recording medium. Even when the amount of the amorphous resin (B-1) is relatively large, the occurrence of hot offset due to the lowering of viscosity can be prevented.

In some embodiments, the content of the colorant is from 1 to 30% by weight, or from 3 to 20% by weight, based on total weight of resins in the toner.

According to an embodiment, the toner includes a release agent. Specific examples of usable release agents include, but are not limited to, low-molecular-weight polyolefin waxes (e.g., low-molecular-weight polyethylene, low-molecular-weight polypropylene), synthetic hydrocarbon waxes (e.g., Fischer-Tropsch wax), natural waxes (e.g., bees wax, carnauba wax, candelilla wax, rice wax, montan wax), petroleum waxes (e.g., paraffin wax, microcrystalline wax), higher fatty acids (e.g., stearic acid, palmitic acid, myristic acid), metal salts of the higher fatty acids, higher fatty acid amides, and synthetic ester waxes, and modified products of the above materials.

In some embodiments, carnauba wax, modified carnauba wax, polyethylene wax, or synthetic ester wax is preferred. In particular, carnauba wax can be properly and finely dispersed in polyester or polyol resins. The resulting toner provides a good combination of hot offset resistance, transferability, and durability. In a case in which the release agent is used in combination with the fatty acid amide compound, the release agent strongly remain on a fixed toner image. Thus, the toner image gets resistant to rubbing or smear.

Two or more of these release agents can be used in combination. In some embodiments, the content of the release agent is from 2 to 15% by weight based on total weight of the toner. When the content is less than 2% by weight, hot offset resistance of the toner may be poor. When the content exceeds 15% by weight, transferability and durability of the toner may be poor.

In some embodiments, the release agent has a melting point of from 70 to 150° C. When the melting point is less than 70° C., heat-resistant storage stability of the toner may be poor. When the melting point exceeds 150° C., releasability of the toner may be poor.

According to some embodiments, the toner has a volume average particle diameter of from 4 to 10 μm for producing high-quality image with excellent thin-line reproducibility.

When the volume average particle diameter is less than 4 μm, cleanability in the developing process and transfer efficiency in the transfer process are degraded and the resulting image quality is poor. When volume average particle diameter exceeds 10 μm, thin-line reproducibility is poor.

Volume average particle diameter can be measured by, for example, an instrument COULTER COUNTER TA-II available from Beckman Coulter, Inc.

In accordance with some embodiments, the toner is prepared by a pulverization method or a polymerization method. Applicable polymerization methods include all the known methods. In some embodiments, a pulverization method that includes a melting and kneading process is preferred because the peak ratio C/R is controllable.

A pulverization method includes the steps of dry-mixing raw materials, including the crystalline polyester resin (A), amorphous resin (B), and composite resin (C) and other optional materials such as a colorant, a release agent, or a charge controlling agent; melt-kneading the mixture by a kneader; and pulverizing the kneaded product.

In the melt-kneading step, a mixture of raw materials is melt-kneaded by a melt-kneader. Usable melt-kneaders include single-axis or double-axis continuous kneaders and roll mill batch kneaders. Specific examples of commercially-available melt-kneaders include, but are not limited to, TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KOKNEADER (from Buss Corporation).

The melt-kneading conditions are adjusted so as not to cut molecular chains of the binder resin. For example, when the melt-kneading temperature is too much higher than the softening point of the binder resin, molecular chains may be excessively cut. When the melt-kneading temperature is too much lower than the softening point of the binder resin, the raw materials may not be sufficiently kneaded.

Next, in the pulverization step, the resulting kneaded product is pulverized. The kneaded product may be first pulverized into coarse particles and subsequently pulverized into fine particles. Specific pulverization methods include, for example, a method in which the kneaded product is brought into collision with a collision plate in a jet stream, a method in which particles are brought into collision with each other in a jet stream, and a method in which the kneaded product is pulverized within a narrow gap between mechanically rotating rotor and stator.

In the classification step, the resulting particles are classified by size, and particles within a predetermined size range are collected. Undesired fine particles are removed by cyclone separation, decantation, or centrifugal separation, for example.

In some embodiments, the raw materials having been kneaded in the melt-kneading step are cooled in a manner such that the kneaded product has a thickness of 2.5 mm or more. This means that the kneaded product is cooled slowly and therefore the crystalline polyester resin (A) can be exposed to recrystallization process for an extended period of time. Thus, in such embodiments, recrystallization of the crystalline polyester resin (A) is accelerated and the toner effectively exerts the effect of the crystalline polyester resin (A). It is possible to accelerate recrystallization by both including a fatty acid amide in the toner, as aforementioned, or by adjusting the manufacture conditions. When the thickness of the kneaded product exceeds 8 mm, the pulverization efficiency may deteriorate and the absolute values for C and R may be too large.

The kneaded product may be in the form of block which needs an excessive time period to be cooled. Such a block-like product also lowers the pulverization efficiency. For this reason, according to some embodiments, the kneaded product is extended by pressure and formed into a platy shape. The kneaded product thus formed into a platy shape having a thickness of 2.5 mm or more can be cooled in a gradual manner so that recrystallization of the crystalline polyester resin (A) is accelerated.

The toner may be externally mixed with inorganic fine particles, such as hydrophobized silica particle, to improve fluidity, storage stability, developability, and transferability.

The toner may be mixed with such external additives by a powder mixer equipped with a jacket so that the inner temperature is variable. To vary load history given to the external additive, the external additive may be gradually added or added from the middle of the mixing, while optionally varying the revolution, rotating speed, time, and temperature in the mixing.

The load may be initially strong and gradually weaken, or vice versa. Specific usable mixers include, but are not limited to, a V-type mixer, a Rocking mixer, a Loedige mixer, a Nauta mixer, and a Henschel mixer.

After being mixed with the external additive, undesired coarse or aggregated toner particles are removed by a sieve having a mesh size of 250 or more.

In accordance with some embodiments, a one-component developer consisting of the toner according to an embodiment and a two-component developer consisting of the toner according to an embodiment and a carrier are provided. The two-component developer may be used for high-speed printers in accordance with recent improvement in information processing speed because of having a long lifespan.

Figure 6:
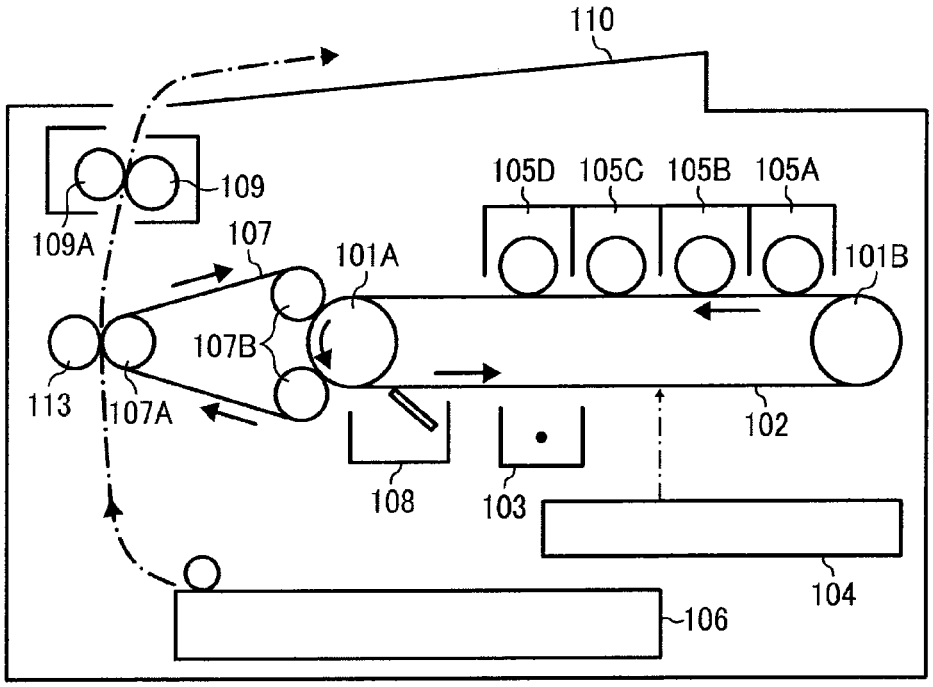
FIG. 6 is a schematic view illustrating an electrophotographic image forming apparatus according to an embodiment.

FIG. 6 is a schematic view illustrating an electrophotographic image forming apparatus according to an embodiment. An image forming method according to an embodiment can be practiced by this above-described image forming apparatus.

The electrophotographic image forming apparatus includes a driving roller 101A, a driven roller 101B, a photoreceptor belt 102 serving as an image bearing member, a charger 103, a laser writing unit 104 serving as an exposure device, developing units 105A, 105B, 105C, and 105D containing respective toners of yellow, magenta, cyan, and black, a paper feed cassette 106, an intermediate transfer belt 107, a driving axial roller 107A to drive the intermediate transfer belt 107, a pair of driven axial rollers 107B to support the intermediate transfer belt 107, a cleaner 108, a fixing roller 109, a pressing roller 109A, a paper ejection tray 110, and a paper transfer roller 113. The intermediate transfer belt 107, driving axial roller 107A, and driven axial rollers 107B form an intermediate transfer device. The fixing roller 109 and pressing roller 109A form a fixing device.

The intermediate transfer belt 107 is flexible. The intermediate transfer belt 107 is stretched taut across the driving axial roller 107A and the pair of driven axial rollers 107B and is circularly conveyed clockwise in FIG. 6. A surface of the intermediate transfer belt 107 between the pair of driven axial rollers 107B is laterally in contact with the photoreceptor belt 102 on an outer periphery of the driving roller 101A.

In normal image forming operations, toner images formed on the photoreceptor belt 102 are each transferred onto the intermediate transfer belt 107 and superimposed on one another so that a full-color composite toner image is formed thereon. The paper transfer roller 113 transfers the composite toner image onto a transfer paper fed from the paper feed cassette 106. The transfer paper having the composite toner image thereon is fed to between the fixing roller 109 and the pressing roller 109A so that the composite toner image is fixed on the transfer paper by the fixing roller 109 and the pressing roller 109A. The transfer paper having the fixed toner image is ejected onto the paper ejection tray 110.

In the developing units 105A to 105D, the toner concentration in the developer decreases along with sequential development of electrostatic latent images into toner images. A toner concentration decrease is detected by a toner concentration detector. Upon detection of toner concentration decrease, a toner supplier connected to each developing unit supplies toner to the connected developing unit so as to increase the toner concentration. When the developing units have a developer discharge mechanism, a mixture of carrier and toner, i.e., a trickle developer, may be supplied.

According to another embodiment, toner images may be directly transferred from a transfer drum onto a recording medium without using an intermediate transfer belt.

Figure 7:
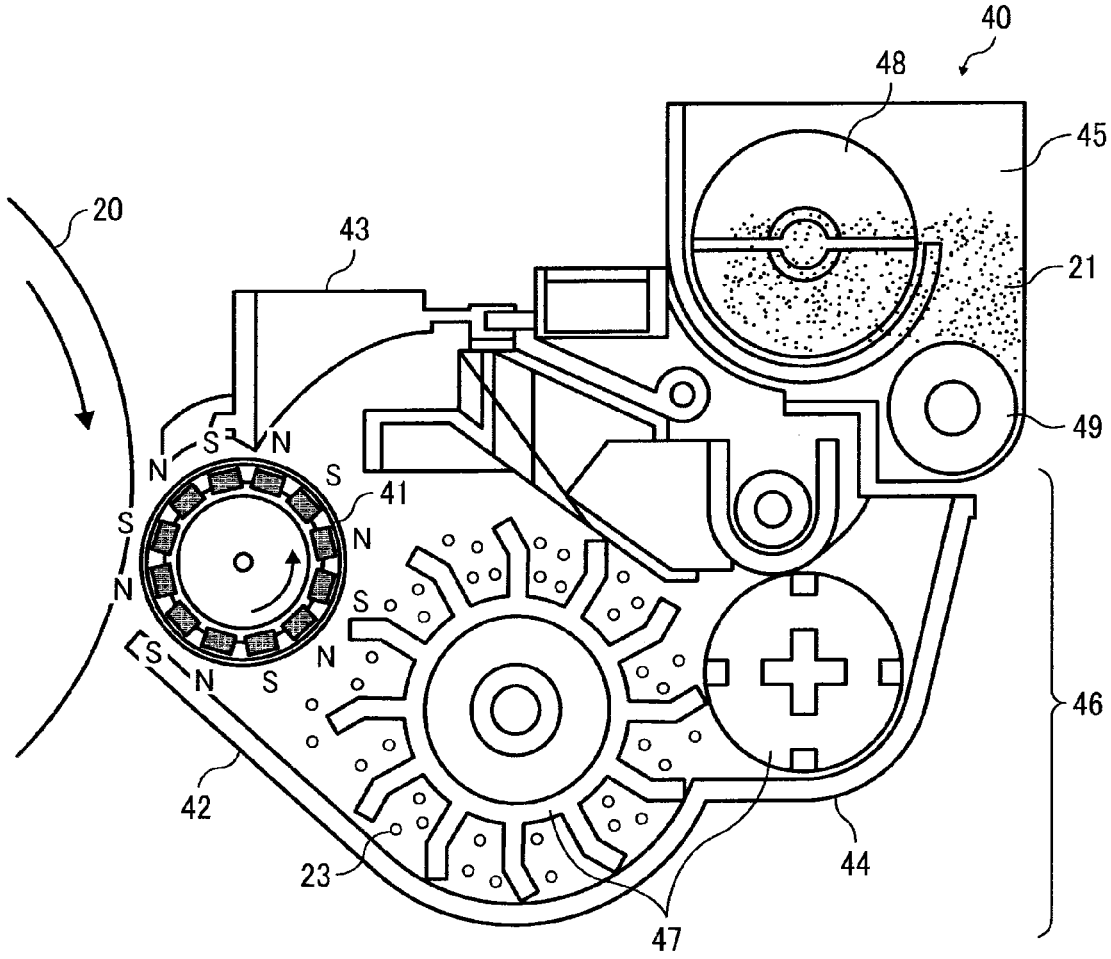
FIG. 7 is a schematic view illustrating a developing device according to an embodiment.

FIG. 7 is a schematic view illustrating a developing device according to an embodiment.

A developing device 40 is disposed facing a photoreceptor 20 serving as an image bearing member. The developing device 40 includes a developing sleeve (magnetic roll) 41 serving as a developer bearing member, a developer container 42, a doctor blade 43 serving as a regulation member, and a support casing 44. In the present embodiment, the number of magnetic roll is 1. In another embodiment, the number of magnetic roll is 2 or more.

The support casing 44 has an opening on a side facing the photoreceptor 20. A toner hopper 45 serving as a toner container that contains toner particles 21 is attached to the support casing 44. A developer containing part 46 contains a developer comprising the toner particles 21 and carrier particles 23. A developer agitator 47 agitates the toner particles 21 and carrier particles 23 to frictionally charge the toner particles 21.

A toner agitator 48 and a toner supplying mechanism 49 each rotated by driving mechanisms are provided in the toner hopper 45. The toner agitator 48 and the toner supplying mechanism 49 agitate and supply the toner particles 21 in the toner hopper 45 toward the developer containing part 46.

The developing sleeve 41 is disposed within a space between the photoreceptor 20 and the toner hopper 45. The developing sleeve 41 is driven to rotate in a direction indicated by arrow in FIG. 7 by a driving mechanism. The developing sleeve 41 internally contains a magnet serving as a magnetic field generator so that magnetic brushes are formed thereon from the carrier particles 23. The relative position of the magnet to the developing device 40 remains unchanged.

The doctor blade 43 is integrally provided to the developer container 42 on the opposite side of the support casing 44. A constant gap is formed between the tip of the doctor blade 43 and a circumferential surface of the developing sleeve 41.

In this electrophotographic image forming method according to an embodiment, the toner agitator 48 and the toner supplying mechanism 49 feed the toner particles 21 from the toner hopper 45 to the developer containing part 46. The developer agitator 47 agitates the toner particles 21 and the carrier particles 23 to frictionally charge the toner particles 21. The developing sleeve 41 bears the charged toner particles 21 and the carrier particles 23, and rotationally conveys them to a position where the developing sleeve 41 faces an outer peripheral surface of the photoreceptor 20. The toner particles 21 then electrostatically bind to an electrostatic latent image formed on the photoreceptor 20. Thus, a toner image is formed on the photoreceptor 20.

Figure 8:
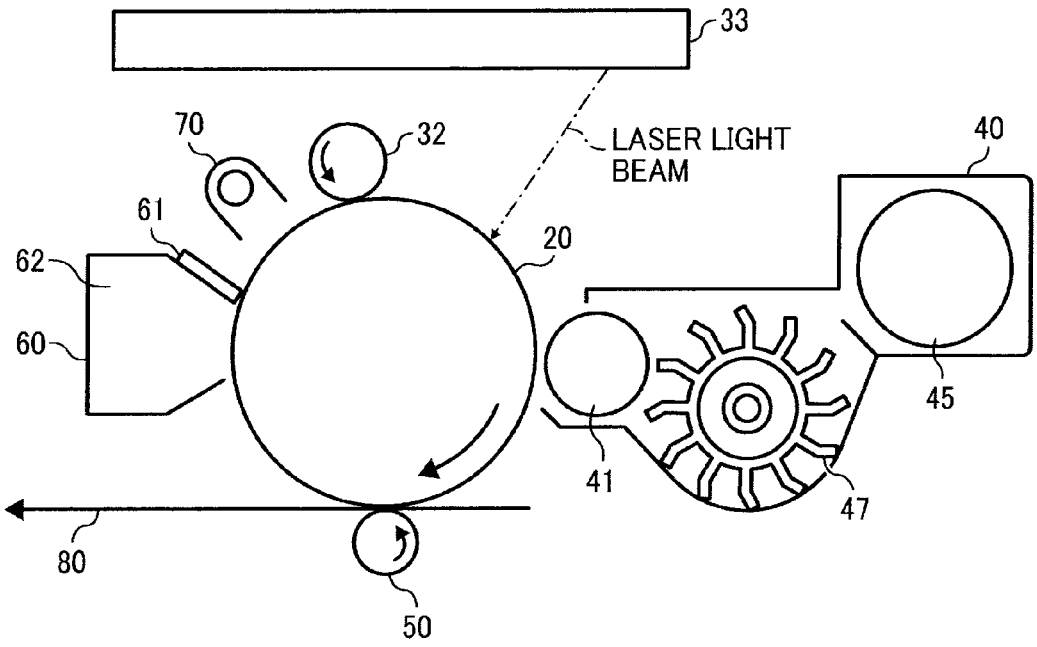
FIG. 8 is a schematic view illustrating an image forming apparatus including the developing device illustrated in FIG. 7.

FIG. 8 is a schematic view illustrating an image forming apparatus including the developing device illustrated in FIG. 7. Around the photoreceptor 20, a charging member 32, an irradiator 33, the developing device 40, a transfer member 50, a cleaning device 60, and a neutralization lamp 70 are provided. A gap of about 0.2 mm is formed between a surface of the charging member 32 and a surface of the photoreceptor 20. A voltage supplying mechanism supplies the charging member 32 with an electric filed in which an alternating current component is overlapped with a direct current component so that the photoreceptor 20 is uniformly charged.

This image forming apparatus employs a negative-positive image forming process. The photoreceptor 20 having an organic photoconductive layer is neutralized by the neutralization lamp 70, and then negatively charged by the charging member 32. The charged photoreceptor 20 is irradiated with laser light emitted from the irradiator 33 so that an electrostatic latent image is formed thereon. In this embodiment, the absolute potential value of the irradiated portion is lower than that of the non-irradiated portion.

The laser light is emitted from a semiconductive laser. A polygon mirror that is a polygonal columnar mirror rotating at a high speed scans the surface of the photoreceptor 20 with the laser light in the axial direction. The electrostatic latent image thus formed is then developed into a toner image with a developer comprised of toner and carrier particles supplied to a developing sleeve 41 in the developing device 40. When developing an electrostatic latent image, a voltage supplying mechanism supplies a developing bias that is a predetermined direct current voltage or that overlapped with an alternating current voltage, to between the developing sleeve 41 and the irradiated and non-irradiated portions on the photoreceptor 20.

On the other hand, a transfer medium 80 (e.g., paper) is fed from a paper feed mechanism. A pair of registration rollers feeds the transfer medium 80 to a gap between the photoreceptor 20 and the transfer member 50 in synchronization with an entry of the toner image to the gap so that the toner image is transferred onto the transfer medium 80. When transferring a toner image, a transfer bias that is a voltage having the opposite polarity to the toner charge is applied to the transfer member 50. Thereafter, the transfer medium 80 having the transferred toner image thereon separates from the photoreceptor 20.

Toner particles remaining on the photoreceptor 20 are removed by a cleaning blade 61 and collected in a toner collection chamber 62 in the cleaning device 60.

The collected toner particles may be refed to the developer containing part 46 and/or the toner hopper 45 by a recycle mechanism so as to be recycled.

The image forming apparatus may include multiple developing devices. In this case, multiple toner images are sequentially transferred onto a transfer medium to form a composite toner image, and the composite toner image is finally fixed on the transfer medium. The image forming apparatus may further include and an intermediate transfer member. In this case, multiple toner images are transferred onto the intermediate transfer member to form a composite toner image, and the composite toner image is then transferred onto and fixed on a transfer medium.

Figure 9:
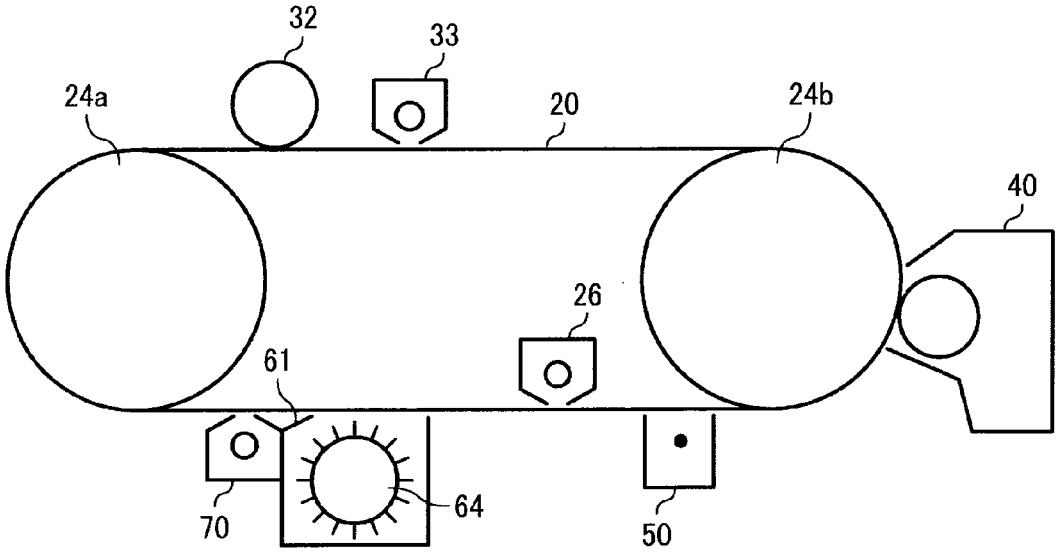
FIG. 9 is a schematic view illustrating an image forming apparatus according to another embodiment.

FIG. 9 is a schematic view illustrating an image forming apparatus according to another embodiment. The photoreceptor 20, having a conductive substrate and a photosensitive layer overlying thereon, is driven by driving rollers 24*a* and 24*b*. The photoreceptor 20 is repeatedly subjected to the processes of charging by a charging member 32, irradiation by an irradiator 40, development by a developing device 40, transfer by a transfer member 50, pre-cleaning irradiation by a light source 26, cleaning by a cleaning brush 64 and a cleaning blade 61, and neutralization by a neutralization lamp 70. In the pre-cleaning irradiation process, light is emitted from the back side of the photoreceptor 20. Therefore, in this embodiment, the conductive substrate is translucent.

Figure 10:
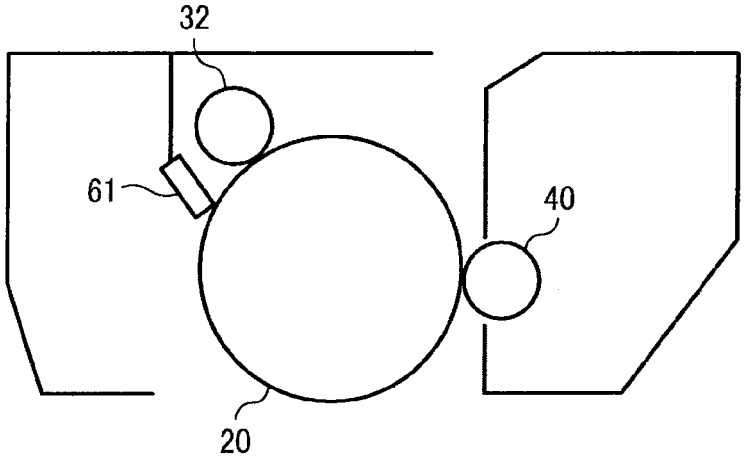
FIG. 10 is a schematic view illustrating a process cartridge according to an embodiment.

FIG. 10 is a schematic view illustrating a process cartridge according to an embodiment. The process cartridge integrally supports a photoreceptor 20, a charging member 32, a developing device 40 containing the developer according to an embodiment, and a cleaning blade 61. The process cartridge is detachably attachable to image forming apparatuses. The process cartridge is detachably attachable to image forming apparatuses.

Figure 11:
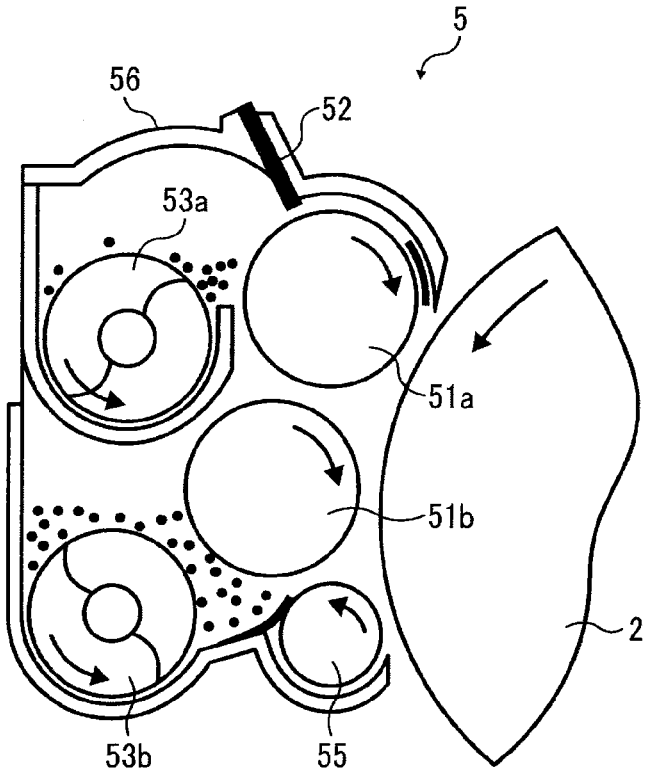
FIG. 11 is a schematic view illustrating an image forming apparatus according to another embodiment.

FIG. 11 is a schematic view illustrating an image forming apparatus according to another embodiment.

A developing device 5 is a two-stage developing device including two developing sleeves (magnetic rolls). The developing device 5 has a first developing sleeve 51*a* and a second developing sleeve 51*b* both disposed within a casing 56. The first developing sleeve 51*a* is an upstream developing sleeve and the second developing sleeve 51*b* is a downstream developing sleeve relative to the direction of movement of the surface of the photoreceptor 2. Each of the first developing sleeve 51*a* and second developing sleeve 51*b* contains a magnet roll to which a magnet that generates a magnetic field is fixed. Each of them serves as a developer bearing member to bear a two-component developer, comprising toner particles and magnetic carrier particles, on its surface.

Each of the first developing sleeve 51*a* and second developing sleeve 51*b* is disposed facing a surface of the photoreceptor 2 to form each developing area. The developing device 5 further includes a doctor blade 52 to regulate the thickness of the developer on the first developing sleeve 51*a*. The developing device 5 further includes a supply screw 53*a* to agitate and feed the developer to be supplied to the first developing sleeve 51*a*, and a developer supply path. The developing device 5 further includes a collection screw 53*b* to agitate and feed the developer collected from the second developing sleeve 51*b*, a developer collection path, and a carrier collection roller 55 to collect carrier particles from the second developing sleeve 51*b*.

Each of the first developing sleeve 51*a* and second developing sleeve 51*b* is a cylindrical member formed of nonmagnetic materials such as aluminum, brass, stainless steel, or conductive resins, and is driven to rotate clockwise in FIG. 11 by a rotary drive mechanism. Magnetic carrier particles in the developer are formed into chainlike aggregates on the first developing sleeve 51*a* and second developing sleeve 51*b* along the magnetic field lines generated from each magnet in the normal direction thereof. The charged carrier particles are adhered to the chainlike aggregates of the magnetic carrier particles to form so-called "magnetic ears". The magnetic ears are conveyed clockwise as the first developing sleeve 51*a* and second developing sleeve 51*b* rotate.

The magnet roll contained in each of the first developing sleeve 51*a* and second developing sleeve 51*b* may be formed of, for example, a plastic magnet or rubber magnet that is a mixture of magnetic powder (e.g., Sr ferrite, Ba ferrite) with polymeric compounds (e.g., polyamide (PA) materials such as 6PA and 12PA, ethylene-based compounds such as ethylene-ethyl copolymer (EEA) and ethylene-vinyl copolymer (EVA), chlorine-based materials such as chlorinated polyethylene (CPE), rubber materials such as NBR). The magnet is M the form of a rod-like block extending along the axial direction of the developing roller. The magnet may be made of a material satisfying an inequation Br>0.5 T (Tesla) so as to have high and sharp magnetic property. Specific examples of such materials include a plastic magnet or rubber magnet that is a mixture of Ne-based (e.g., Ne—Fe—B) or Sm-based (e.g., Sm—Co, Sm—Fe—N) rare-earth magnets or powders thereof with the above-described polymeric compounds.

The doctor blade 52 is disposed facing a surface of the first developing sleeve 51*a* at an upstream side from the first developing area formed between the first developing sleeve 51*a* and the photoreceptor 2. The doctor blade 52 is facing the first developing sleeve 51*a* while forming a regulation gap therebetween for regulating the amount of the developer to be conveyed to the first developing area. The doctor blade 52 is a platy member made of nonmagnetic metallic materials (including weakly magnetic metallic materials), such as SUS316 and XM7, having a thickness of about 2 mm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Pulverization Toners

Raw Materials of Pulverization Toner 1

Crystalline polyester resin a-1: 4 parts
Amorphous resin b1-1: 35 parts
Amorphous resin b2-1: 55 parts
Composite resin c-1: 10 parts
Colorant p-1: 14 parts
Release agent (Carnauba wax having a melting point of 81° C.): 6 parts
Charge controlling agent (Monoazo metal complex BONTRON S-34 (chromium-based complex salt dye) available from Orient Chemical Industries Co., Ltd.): 2 parts Premix the above raw materials by a HESCHEL MIXER FM20B (from MITSUI MIIKE MACHINERY Co., Ltd.). Melt-knead the mixture by a double-axis kneader (PCM-30 from Ikegai Co., Ltd.) at 100 to 130° C. Extend the kneaded product by applying pressure with a roller to form it into a plate having a thickness of 2.7 mm. After cooling the plate to room temperature by a belt cooler, coarsely pulverize the plate into coarse particles having a size of from 200 to 300 μm by a hammer mill. Finely pulverize the coarse particles into fine particles by an ultrasonic jet pulverizer LABOJET (from Nippon Pneumatic Mfg. Co., Ltd.). Subject the fine particles to classification by an airflow classifier MDS-I (from Nippon Pneumatic Mfg. Co., Ltd.) while controlling the louver opening so that the collected particles have a weight average particle diameter of 6.9±0.2 μm. Thus, mother toner particles are prepared. Mix 100 parts of the mother toner particles with 1.0 part of an additive HDK-2000 (from Clariant) by a HENSCHEL MIXER. Thus, a pulverization toner 1 is prepared.

Uniformly mix 5% of the pulverization toner 1 and 95% of a coated ferrite carrier by TURBULA® MIXER (from Willy a. Bachofen AG) for 5 minutes at 48 rpm to prepare a pulverization toner developer 1.

Examples 2 to 30 and Comparative Examples 1 to 8

Repeat the procedure in Example 1 except for changing the raw materials according to Tables 1 to 6. Thus, toners 2 to 38 and developers 2 to 38 are prepared.

In preparing a toner 33, an amorphous resin b2-3 is premixed with pure water to prepare a master batch colorant p-2 to improve dispersibility of the colorant. The amount of the amorphous resin b2-3 described in Table 6 is total amount of it to be included in the toner, a part of which comes from the master batch colorant p-2.

Preparation of Master Batch for Toner 33

Amorphous resin b2-3: 100 parts

Colorant p-2: 50 parts

Pure water: 50 parts

The method of preparing master batch is not limited to the above-described method.

In Examples 28 to 30, the charge controlling agent is replaced with a salicylic acid zinc compound BONTRON E-34 available from Orient Chemical Industries Co., Ltd.

TABLE 1

| Crystalline polyester resin (A) | Glass transition temp. Tg (° C.) | Softening temp. T½ (° C.) | Ester bond (I) | Alcohol components | Carboxylic acid components |
|---|---|---|---|---|---|
| a-1 | 98 | 104 | N/A | 1,5-Pentanediol | Fumaric acid |
| a-2 | 81 | 86 | N/A | 1,4-Butanediol | Terephthalic acid |
| a-3 | 84 | 89 | N/A | 1,5-Pentanediol | Maleic acid |
| a-4 | 116 | 122 | N/A | 1,6-Hexanediol | Terephthalic acid |
| a-5 | 119 | 126 | N/A | 1,5-Pentanediol | Terephthalic acid |
| a-6 | 100 | 106 | Present | 1,6-Hexanediol | Fumaric acid |

Each of the crystalline polyester resins a-1 to a-6 is obtained from an alcohol component selected from 1,4-butanediol, 1,5-pentanediol, and 1,6-hexanediol and a carboxylic acid component selected from fumaric acid, maleic acid, and terephthalic acid.

More specifically, each of the crystalline polyester resins is obtained as follows. Subject monomers (alcohol components and carboxylic acid components) described in Table 1 to an esterification reaction at 170 to 260° C. under normal pressure without catalyst. After further adding antimony trioxide in an amount of 400 ppm based on total weight of the carboxylic acid monomers, subject the monomers to a polycondensation at 250° C. under vacuum at 3 Torr while removing the produced glycol. Continue the cross-linking reaction until the agitation torque becomes 10 kg·cm (100 ppm). Terminate the reaction by breaking the reduced pressure condition.

Each of the crystalline polyester resins a-1 to a-6 has at least one peak within a 2θ range from 19° to 25° in its X-ray diffraction pattern measured by an X-ray diffractometer, which indicates that each of these polyester resins has crystallinity. An X-ray diffraction pattern of the crystalline polyester resin a-6 is shown in FIG. 4.

TABLE 2

| Amorphous resin (B-1) | Material | Softening temp. (° C.) | Chloroform-insoluble contents (% by weight) | Acid components | Alcohol components |
|---|---|---|---|---|---|
| b1-1 | Polyester | 140 | 21 | Fumaric Acid<br>Trimellitic anhydride | Bisphenol A (2,2) propylene oxide<br>Bisphenol A (2,2) ethylene oxide |
| b1-2 | Polyester | 145 | 4 | Isophthalic Acid<br>Trimellitic anhydride | Bisphenol A (2,2) propylene oxide<br>Bisphenol A (2,2) ethylene oxide |
| b1-3 | Polyester | 140 | 6 | Fumaric Acid<br>Trimellitic anhydride | Bisphenol A (2,2) propylene oxide<br>Bisphenol A (2,2) ethylene oxide |
| b1-4 | Polyester | 151 | 39 | Dodecenyl succinic anhydride<br>Trimellitic anhydride | Bisphenol A (2,2) propylene oxide<br>Bisphenol A (2,2) ethylene oxide |
| b1-5 | Polyester | 141 | 41 | Fumaric Acid<br>Trimellitic anhydride | Ethylene glycol<br>Bisphenol A (2,2) propylene oxide<br>Bisphenol A (2,2) ethylene oxide |
| b1-6 | Styrene-acrylic | 165 | 13 | Styrene-methyl acrylate copolymer resin | |

TABLE 3

| Amorphous resin (B-1) | Material | Softening temp. (° C.) | Glass transition temp. (° C.) | Molecular weight distribution Main peak | Molecular weight distribution Half bandwidth |
|---|---|---|---|---|---|
| b2-1 | Polyester | 100 | 63 | 5,000 | 17,000 |
| b2-2 | Styrene-acrylic | 135 | 60 | 14,000 | 31,000 |
| b2-3 | Polyester | 89 | 62 | 4,000 | 13,000 |

TABLE 4

| Composite resin (C) | Condensation polymerization resin unit | Addition polymerization resin unit |
|---|---|---|
| c-1 | Polyester-based | Vinyl-based |
| c-2 | Polyamide-based | Vinyl-based |

Each of the amorphous resins b1-1 to b1-6, b2-1 to b2-3, and c-1 to c-2 is obtained as follows.

Subject monomers selected from aromatic diols, ethylene glycol, glycerin, adipic acid, terephthalic acid, isophthalic acid, and itaconic acid to an esterification reaction at 170 to 260° C. under normal pressure without catalyst. After further adding antimony trioxide in an amount of 400 ppm based on total weight of the carboxylic acid monomers, subject the monomers to a polycondensation at 250° C. under vacuum at 3 Torr while removing the produced glycol. Continue the cross-linking reaction until the agitation torque becomes 10 kg·cm (100 ppm). Terminate the reaction by breaking the reduced pressure condition.

Preparation of Composite Resin c-1

Charge a 5-liter four-necked flask equipped with a nitrogen inlet pipe, a dewatering pipe, a stirrer, a dropping funnel, and a thermocouple with condensation polymerizable monomers including 0.8 mol of terephthalic acid, 0.6 mol of fumaric acid, 0.8 mol of trimellitic anhydride, 1.1 mol of bisphenol A (2,2)-propylene oxide, and 0.5 mol of bisphenol A (2,2)-ethylene oxide; and 9.5 mol of dibutyltin oxide as an esterification catalyst. Heat the mixture to 135° C. under nitrogen atmosphere.

Charge the dropping funnel with addition polymerizable monomers including 10.5 mol of styrene, 3 mol of acrylic acid, and 1.5 mol of 2-ethylhexyl acrylate; and 0.24 mol of t-butyl hydroperoxide as a polymerization initiator. Drop the mixture into the flask over a period of 5 hours. Subject the mixture in the flask to a reaction for 6 hours.

Heat the reaction system to 210° C. over a period of 3 hours. Continue the reaction at 210° C. and 10 kPa until the reaction product has a desired softening temperature. Thus, a composite resin c-1 is prepared.

The composite resin c-1 has a softening temperature of 115° C., a glass transition temperature of 58, and an acid value of 25 mgKOH/g.

Preparation of Composite Resin c-2

Repeat the procedure in preparing the composite resin c-1 except for replacing the condensation polymerizable monomers with hexamethylenediamine and ϵ-caprolactam and replacing the addition polymerizable monomers with styrene, acrylic acid, and 2-ethylhexyl acrylate. Thus, a composite resin c-2 is prepared.

Each of the amorphous resins b1-1 to b1-6, b2-1 to b2-3, and c-1 to c-2 has no peak in its X-ray diffraction pattern measured by an X-ray diffractometer, which indicates that each of these polyester resins is amorphous.

Each of the amorphous resins b2-1 to b2-3 is completely soluble in chloroform and includes no chloroform-insoluble contents.

TABLE 5

| Colorant | Material |
|---|---|
| p-1 | Carbon black |
| p-2 | Phthalocyanine blue |

TABLE 6-1

| | Toner No. | Crystalline polyester resin (A) | Amorphous resin (B1) | Amorphous resin (B2) | Composite resin (C) | Colorant |
|---|---|---|---|---|---|---|
| Ex. 1 | 1 | a-1/4 parts | b1-1/35 parts | b2-1/55 parts | c-1/10 parts | p-1/14 parts |
| Comp. Ex. 1 | 2 | — | b1-1/35 parts | b2-1/55 parts | c-1/10 parts | p-1/14 parts |
| Comp. Ex. 2 | 3 | a-1/4 parts | — | b2-1/55 parts | c-1/10 parts | p-1/14 parts |
| Comp. Ex. 3 | 4 | a-1/4 parts | b1-1/35 parts | b2-1/55 parts | — | p-1/14 parts |
| Comp. Ex. 4 | 5 | a-1/4 parts | b1-1/45 parts | b2-1/45 parts | c-1/10 parts | p-1/14 parts |
| Ex. 2 | 6 | a-1/4 parts | b1-1/40 parts | b2-1/50 parts | c-1/10 parts | p-1/14 parts |
| Ex. 3 | 7 | a-1/4 parts | b1-1/25 parts | b2-1/65 parts | c-1/10 parts | p-1/14 parts |
| Comp. Ex. 5 | 8 | a-1/4 parts | b1-1/20 parts | b2-1/70 parts | c-1/10 parts | p-1/14 parts |
| Ex. 4 | 9 | a-1/4 parts | b1-1/28 parts | b2-1/62 parts | c-1/5 parts | p-1/14 parts |
| Comp. Ex. 6 | 10 | a-1/4 parts | b1-1/30 parts | b2-1/60 parts | c-1/5 parts | p-1/14 parts |
| Comp. Ex. 7 | 11 | a-1/0.8 parts | b1-1/35 parts | b2-1/55 parts | c-1/10 parts | p-1/14 parts |
| Ex. 5 | 12 | a-1/1.5 parts | b1-1/35 parts | b2-1/55 parts | c-1/10 parts | p-1/14 parts |
| Ex. 6 | 13 | a-1/14 parts | b1-1/35 parts | b2-1/55 parts | c-1/10 parts | p-1/14 parts |
| Comp. Ex. 8 | 14 | a-1/16 parts | b1-1/35 parts | b2-1/55 parts | c-1/10 parts | p-1/14 parts |
| Ex. 7 | 15 | a-1/4 parts | b1-3/10 parts | b2-3/80 parts | c-1/10 parts | p-1/14 parts |
| Ex. 8 | 16 | a-1/4 parts | b1-3/14 parts | b2-3/76 parts | c-1/10 parts | p-1/14 parts |
| Ex. 9 | 17 | a-1/4 parts | b1-4/70 parts | b2-3/20 parts | c-1/10 parts | p-1/14 parts |
| Ex. 10 | 18 | a-1/4 parts | b1-4/78 parts | b2-3/12 parts | c-1/10 parts | p-1/14 parts |
| Ex. 11 | 19 | a-2/4 parts | b1-1/35 parts | b2-1/55 parts | c-1/10 parts | p-1/14 parts |
| Ex. 12 | 20 | a-3/4 parts | b1-1/35 parts | b2-1/55 parts | c-1/10 parts | p-1/14 parts |
| Ex. 13 | 21 | a-1/1 part | b1-1/35 parts | b2-1/55 parts | c-1/10 parts | p-1/14 parts |
| Ex. 14 | 22 | a-1/15 parts | b1-1/35 parts | b2-1/55 parts | c-1/10 parts | p-1/14 parts |
| Ex. 15 | 23 | a-4/4 parts | b1-1/35 parts | b2-1/55 parts | c-1/10 parts | p-1/14 parts |
| Ex. 16 | 24 | a-5/4 parts | b1-1/35 parts | b2-1/55 parts | c-1/10 parts | p-1/14 parts |
| Ex. 17 | 25 | a-1/4 parts | b1-1/90 parts | — | c-1/10 parts | p-1/14 parts |
| Ex. 18 | 26 | a-1/4 parts | b1-1/35 parts | b2-2/55 parts | c-1/10 parts | p-1/14 parts |
| Ex. 19 | 27 | a-1/4 parts | b1-6/35 parts | b2-3/55 parts | c-1/10 parts | p-1/14 parts |
| Ex. 20 | 28 | a-1/4 parts | b1-2/35 parts | b2-3/55 parts | c-1/10 parts | p-1/14 parts |
| Ex. 21 | 29 | a-1/4 parts | b1-3/35 parts | b2-3/55 parts | c-1/10 parts | p-1/14 parts |
| Ex. 22 | 30 | a-1/4 parts | b1-4/35 parts | b2-3/55 parts | c-1/10 parts | p-1/14 parts |
| Ex. 23 | 31 | a-1/4 parts | b1-5/35 parts | b2-3/55 parts | c-1/10 parts | p-1/14 parts |
| Ex. 24 | 32 | a-1/4 parts | b1-1/35 parts | b2-3/55 parts | c-1/10 parts | p-1/14 parts |
| Ex. 25 | 33 | a-1/4 parts | b1-1/35 parts | b2-3/55 parts | c-1/10 parts | p-2/14 parts |
| Ex. 26 | 34 | a-6/4 parts | b1-1/35 parts | b2-3/55 parts | c-1/10 parts | p-1/14 parts |
| Ex. 27 | 35 | a-6/4 parts | b1-1/35 parts | b2-3/55 parts | c-2/10 parts | p-1/14 parts |
| Ex. 28 | 36 | a-6/4 parts | b1-1/35 parts | b2-3/55 parts | c-1/10 parts | p-1/14 parts |
| Ex. 29 | 37 | a-6/4 parts | b1-1/35 parts | b2-3/55 parts | c-1/10 parts | p-1/14 parts |
| Ex. 30 | 38 | a-6/4 parts | b1-1/35 parts | b2-3/55 parts | c-1/10 parts | p-1/14 parts |

TABLE 6-2

| | Toner No. | Release agent | Charge controlling agent | Fatty acid amide | Thickness of kneaded product (mm) |
|---|---|---|---|---|---|
| Ex. 1 | 1 | Carnauba wax/6 parts | Monoazo metal complex/2 parts | — | 2.7 |
| Comp. Ex. 1 | 2 | Carnauba wax/6 parts | Monoazo metal complex/2 parts | — | 2.7 |
| Comp. Ex. 2 | 3 | Carnauba wax/6 parts | Monoazo metal complex/2 parts | — | 2.7 |
| Comp. Ex. 3 | 4 | Carnauba wax/6 parts | Monoazo metal complex/2 parts | — | 2.7 |
| Comp. Ex. 4 | 5 | Carnauba wax/6 parts | Monoazo metal complex/2 parts | — | 2.7 |
| Ex. 2 | 6 | Carnauba wax/6 parts | Monoazo metal complex/2 parts | — | 2.7 |
| Ex. 3 | 7 | Carnauba wax/6 parts | Monoazo metal complex/2 parts | — | 2.7 |
| Comp. Ex. 5 | 8 | Carnauba wax/6 parts | Monoazo metal complex/2 parts | — | 2.7 |
| Ex. 4 | 9 | Carnauba wax/6 parts | Monoazo metal complex/2 parts | — | 2.7 |
| Comp. Ex. 6 | 10 | Carnauba wax/6 parts | Monoazo metal complex/2 parts | — | 2.7 |
| Comp. Ex. 7 | 11 | Carnauba wax/6 parts | Monoazo metal complex/2 parts | — | 2.7 |
| Ex. 5 | 12 | Carnauba wax/6 parts | Monoazo metal complex/2 parts | — | 2.7 |
| Ex. 6 | 13 | Carnauba wax/6 parts | Monoazo metal complex/2 parts | — | 2.7 |
| Comp. Ex. 8 | 14 | Carnauba wax/6 parts | Monoazo metal complex/2 parts | — | 2.7 |
| Ex. 7 | 15 | Carnauba wax/6 parts | Monoazo metal complex/2 parts | — | 2.7 |
| Ex. 8 | 16 | Carnauba wax/6 parts | Monoazo metal complex/2 parts | — | 2.7 |
| Ex. 9 | 17 | Carnauba wax/6 parts | Monoazo metal complex/2 parts | — | 2.7 |
| Ex. 10 | 18 | Carnauba wax/6 parts | Monoazo metal complex/2 parts | — | 2.7 |
| Ex. 11 | 19 | Carnauba wax/6 parts | Monoazo metal complex/2 parts | — | 2.7 |
| Ex. 12 | 20 | Carnauba wax/6 parts | Monoazo metal complex/2 parts | — | 2.7 |
| Ex. 13 | 21 | Carnauba wax/6 parts | Monoazo metal complex/2 parts | — | 2.7 |
| Ex. 14 | 22 | Carnauba wax/6 parts | Monoazo metal complex/2 parts | — | 2.7 |
| Ex. 15 | 23 | Carnauba wax/6 parts | Monoazo metal complex/2 parts | — | 2.7 |
| Ex. 16 | 24 | Carnauba wax/6 parts | Monoazo metal complex/2 parts | — | 2.7 |
| Ex. 17 | 25 | Carnauba wax/6 parts | Monoazo metal complex/2 parts | — | 2.7 |
| Ex. 18 | 26 | Carnauba wax/6 parts | Monoazo metal complex/2 parts | — | 2.7 |
| Ex. 19 | 27 | Carnauba wax/6 parts | Monoazo metal complex/2 parts | — | 2.7 |
| Ex. 20 | 28 | Carnauba wax/6 parts | Monoazo metal complex/2 parts | — | 2.7 |
| Ex. 21 | 29 | Carnauba wax/6 parts | Monoazo metal complex/2 parts | — | 2.7 |
| Ex. 22 | 30 | Carnauba wax/6 parts | Monoazo metal complex/2 parts | — | 2.7 |
| Ex. 23 | 31 | Carnauba wax/6 parts | Monoazo metal complex/2 parts | — | 2.7 |
| Ex. 24 | 32 | Carnauba wax/6 parts | Monoazo metal complex/2 parts | N,N'-ethylene-bis stearic acid amide/2 parts | 2.7 |
| Ex. 25 | 33 | Carnauba wax/6 parts | Monoazo metal complex/2 parts | N,N'-ethylene-bis stearic acid amide/2 parts | 2.7 |
| Ex. 26 | 34 | Carnauba wax/6 parts | Monoazo metal complex/2 parts | N,N'-ethylene-bis stearic acid amide/2 parts | 2.7 |
| Ex. 27 | 35 | Carnauba wax/6 parts | Monoazo metal complex/2 parts | N,N'-ethylene-bis stearic acid amide/2 parts | 2.7 |
| Ex. 28 | 36 | Carnauba wax/6 parts | Salicylic acid metal compound/2 parts | N,N'-ethylene-bis stearic acid amide/2 parts | 2.3 |
| Ex. 29 | 37 | Carnauba wax/6 parts | Salicylic acid metal compound/2 parts | N,N'-ethylene-bis stearic acid amide/2 parts | 2.7 |

TABLE 6-2-continued

| | Toner No. | Release agent | Charge controlling agent | Fatty acid amide | Thickness of kneaded product (mm) |
|---|---|---|---|---|---|
| Ex. 30 | 38 | Carnauba wax/6 parts | Salicylic acid metal compound/2 parts | N,N'-ethylene-bis stearic acid amide/2 parts | 2.7 |

Each of the toners is evaluated in terms of main peak of molecular weight distribution, half bandwidth of the main peak, ratio (C/R) determined by an FT-IR ATR method with a Fourier transform infrared spectrometer after each toner is stored in a thermostatic chamber at 45° C. for 12 hours, endothermic peak and quantity originated from the crystalline polyester resin (A) within a temperature range from 90 to 130° C., and volume average particle diameter. The results are shown in Table 7.

TABLE 7

| | Toner No. | Molecular weight distribution: Main peak | Molecular weight distribution: Half bandwidth | C/R | DSC (90-130° C.): Peak temp. (° C.) | DSC (90-130° C.): Endothermic quantity (J/g) | Chloroform-insoluble contents (%) | Volume average particle diameter (μm) |
|---|---|---|---|---|---|---|---|---|
| Ex. 1 | 1 | 7,400 | 13,000 | 0.12 | 108 | 5 | 7 | 6.9 |
| Comp. Ex. 1 | 2 | 7,400 | 13,000 | — | — | — | 8 | 6.9 |
| Comp. Ex. 2 | 3 | 7,400 | 13,000 | 0.12 | 108 | 5 | — | 6.9 |
| Comp. Ex. 3 | 4 | 7,400 | 13,000 | 0.12 | 108 | 5 | 9 | 6.9 |
| Comp. Ex. 4 | 5 | 900 | 9,000 | 0.12 | 108 | 5 | 9 | 6.9 |
| Ex. 2 | 6 | 1,100 | 10,000 | 0.12 | 108 | 5 | 8 | 6.9 |
| Ex. 3 | 7 | 9,800 | 13,800 | 0.12 | 108 | 5 | 5 | 6.9 |
| Comp. Ex. 5 | 8 | 11,000 | 14,100 | 0.12 | 108 | 5 | 4 | 6.9 |
| Ex. 4 | 9 | 8,800 | 14,500 | 0.12 | 108 | 5 | 5 | 6.9 |
| Comp. Ex. 6 | 10 | 9,000 | 16,000 | 0.12 | 108 | 5 | 6 | 6.9 |
| Comp. Ex. 7 | 11 | 7,400 | 13,000 | 0.02 | 108 | 0.6 | 7 | 6.9 |
| Ex. 5 | 12 | 7,400 | 13,000 | 0.05 | 108 | 1.3 | 7 | 6.9 |
| Ex. 6 | 13 | 7,400 | 13,000 | 0.51 | 108 | 14 | 7 | 6.9 |
| Comp. Ex. 8 | 14 | 7,400 | 13,000 | 0.58 | 108 | 17 | 7 | 6.9 |
| Ex. 7 | 15 | 3,500 | 8,500 | 0.12 | 108 | 5 | 0.6 | 6.9 |
| Ex. 8 | 16 | 4,000 | 9,000 | 0.12 | 108 | 5 | 1.1 | 6.9 |
| Ex. 9 | 17 | 9,300 | 12,800 | 0.12 | 108 | 5 | 27 | 6.9 |
| Ex. 10 | 18 | 9,500 | 13,000 | 0.12 | 108 | 5 | 31 | 6.9 |
| Ex. 11 | 19 | 7,400 | 13,000 | 0.10 | 88 | 5 | 7 | 6.9 |
| Ex. 12 | 20 | 7,400 | 13,000 | 0.11 | 92 | 5 | 7 | 6.9 |
| Ex. 13 | 21 | 7,400 | 13,000 | 0.04 | 108 | 0.8 | 7 | 6.9 |
| Ex. 14 | 22 | 7,400 | 13,000 | 0.53 | 108 | 16 | 7 | 6.9 |
| Ex. 15 | 23 | 7,400 | 13,000 | 0.13 | 127 | 5 | 7 | 6.9 |
| Ex. 16 | 24 | 7,400 | 13,000 | 0.14 | 131 | 5 | 7 | 6.9 |
| Ex. 17 | 25 | 9,800 | 14,700 | 0.12 | 108 | 5 | 16 | 6.9 |
| Ex. 18 | 26 | 9,500 | 14,000 | 0.12 | 108 | 5 | 7 | 6.9 |
| Ex. 19 | 27 | 7,700 | 13,000 | 0.12 | 108 | 5 | 4 | 6.9 |
| Ex. 20 | 28 | 3,400 | 8,900 | 0.12 | 108 | 5 | 2 | 6.9 |
| Ex. 21 | 29 | 3,800 | 9,500 | 0.12 | 108 | 5 | 2 | 6.9 |
| Ex. 22 | 30 | 7,500 | 13,100 | 0.12 | 108 | 5 | 12 | 6.9 |
| Ex. 23 | 31 | 8,000 | 13,400 | 0.12 | 108 | 5 | 14 | 6.9 |
| Ex. 24 | 32 | 6,500 | 13,000 | 0.12 | 108 | 5 | 7 | 6.9 |
| Ex. 25 | 33 | 7,000 | 12,500 | 0.12 | 108 | 5 | 9 | 6.9 |
| Ex. 26 | 34 | 7,200 | 12,500 | 0.11 | 110 | 5 | 7 | 6.9 |
| Ex. 27 | 35 | 7,000 | 12,500 | 0.11 | 110 | 5 | 8 | 6.9 |
| Ex. 28 | 36 | 7,000 | 12,500 | 0.08 | 110 | 5 | 7 | 6.9 |
| Ex. 29 | 37 | 7,000 | 12,500 | 0.11 | 110 | 5 | 7 | 4.4 |
| Ex. 30 | 38 | 7,000 | 12,500 | 0.11 | 110 | 5 | 7 | 6.9 |

Set each of the pulverization toner developers 1 to 38 to the developing unit 105D illustrated in FIG. 6 while setting nothing in the developing units 105A to 105C.

Evaluation of Low-temperature Fixability, Hot Offset Resistance, and Thin Line Reproducibility (in Initial Stage)

Produce a solid image having 0.4 mg/cm$^2$ of toner on a paper (TYPE 6200 from Ricoh Co., Ltd.) with the above image forming apparatus containing each of the pulverization toner developers 1 to 38 while setting the linear speed in the fixing to 180 mm/sec and the fixing nip width to 11 mm. Produce such images while varying the fixing temperature at an interval of 5° C. to determine the minimum fixable temperature below which cold offset occurs and the maximum fixable temperature above which hot offset occurs. Additionally, produce a text chart having an image area ratio of 5% (the size of each text is 2 mm×2 mm) at a temperature 20° C. higher than the minimum fixable temperature to evaluate thin line reproducibility by visual observation.

Evaluation Standards for Low-temperature Fixability

A: less than 130° C.

B: not less than 130° C. and less than 140° C.

C: not less than 140° C. and less than 150° C.

D: not less than 150° C. and less than 160° C.

E: not less than 160° C.

Evaluation Standards for Hot Offset Resistance

A: not less than 200° C.

B: not less than 190° C. and less than 200° C.

C: not less than 180° C. and less than 190° C.

D: not less than 170° C. and less than 180° C.

E: less than 170° C.

Evaluation Standards for Thin Line Reproducibility

A: Very good

B: Good

C: Average

D: No problem in practical use

E: Unacceptable

Evaluation of Smear Resistance

Produce a halftone image having 0.40±0.1 mg/cm$^2$ of toner with an image area ratio of 60% on a paper (TYPE 6200 from Ricoh Co., Ltd.) at the minimum fixable temperature. Rub the fixed image with a piece of white cotton cloth (JIS L0803 cotton No. 3) by a clock meter for 10 times. Measure the image density (hereinafter "smear ID") of the cloth with a calorimeter (X-RITE 938) to evaluate the degree of smear of the cloth. The smear ID is measured based on black color except that that of the toner 33 is measured based on cyan color.

Evaluation Standards for Smear Resistance

A: Smear ID is 0.20 or less

B: Smear ID is from 0.21 to 0.35

D: Smear ID is from 0.36 to 0.55

E: Smear ID is 0.56 or more

Evaluation of Thin Line Reproducibility (Temporal)

After evaluating thin line reproducibility in the initial stage, continuously produce an image chart having an image area ratio of 5% on 100 k sheets of paper while supplying toner. Subsequently, produce again a text chart having an image area ratio of 5% (the size of each text is 2 mm×2 mm) at a temperature 20° C. higher than the minimum fixable temperature to evaluate thin line reproducibility by visual observation. Evaluation standards for temporal thin line reproducibility are the same as those for in the initial stage.

Evaluation of Heat-Resistant Storage Stability

Charge a 30-ml screw vial with 10 g of each toner. Subject the vial to tapping by a tapping machine for 100 times. Store the vial in a thermostat chamber at 50° C. for 24 hours. After being returned to room temperature, measure the degree of penetration by a penetrometer to evaluate heat-resistant storage stability.

Evaluation Standards for Heat-resistant Storage Stability

A: completely penetrate

B: not less than 20 mm

C: not less than 15 mm and less than 20 mm

D: not less than 10 mm and less than 15 mm

E: less than 10 mm

Evaluation of Background Fouling (Temporal Image Stability)

Produce images on 500 k sheets by an apparatus RICOH PRO C900 including one magnetic roll and the same apparatus modified to include two magnetic rolls. Visually observe the produced images to evaluate the degree of background fouling.

Evaluation Standards for Image Stability (Temporal Background Fouling Level)

A: Background fouling level 5 (No background fouling is observed)

B: Background fouling level 4 (Acceptable level of background fouling is slightly observed)

C: Background fouling level 3 (Acceptable level of background fouling is observed)

D: Background fouling level 2 (Acceptable level of background fouling is readily observed)

E: Background fouling level 1 (Unacceptable level of background fouling is considerably observed)

The results are shown in Table 8.

TABLE 8

| | Toner No. | Low-temperature fixability | Hot offset resistance | Thin line reproducibility | | Heat-resistant storage stability | Smear resistance | Background fouling (temporal) | |
|---|---|---|---|---|---|---|---|---|---|
| | | | | Initial | Temporal | | | 1 magnetic roll | 2 magnetic rolls |
| Ex. 1 | 1 | B | B | A | A | B | B | C | A |
| Comp. Ex. 1 | 2 | E | B | A | A | D | E | B | A |
| Comp. Ex. 2 | 3 | A | E | A | B | E | B | C | A |
| Comp. Ex. 3 | 4 | B | B | B | D | E | B | C | A |
| Comp. Ex. 4 | 5 | B | E | A | B | E | B | C | A |
| Ex. 2 | 6 | B | D | A | B | C | B | C | A |
| Ex. 3 | 7 | D | B | A | A | B | B | C | A |
| Comp. Ex. 5 | 8 | E | B | A | A | B | B | C | A |
| Ex. 4 | 9 | D | B | A | A | B | B | C | A |
| Comp. Ex. 6 | 10 | E | B | A | A | B | B | C | A |
| Comp. Ex. 7 | 11 | E | B | A | A | A | E | C | A |
| Ex. 5 | 12 | D | B | A | A | A | D | C | A |
| Ex. 6 | 13 | A | B | A | A | D | B | C | A |
| Comp. Ex. 8 | 14 | A | B | A | A | E | B | C | A |
| Ex. 7 | 15 | A | D | A | B | D | A | C | A |
| Ex. 8 | 16 | A | C | A | B | D | A | C | A |
| Ex. 9 | 17 | C | A | A | A | A | B | C | A |
| Ex. 10 | 18 | D | A | A | A | A | D | C | A |
| Ex. 11 | 19 | B | D | A | A | D | B | C | A |
| Ex. 12 | 20 | B | C | A | A | C | B | C | A |
| Ex. 13 | 21 | B | B | A | A | D | B | C | A |
| Ex. 14 | 22 | A | B | A | A | D | B | C | A |
| Ex. 15 | 23 | C | B | A | A | B | B | C | A |
| Ex. 16 | 24 | D | B | A | A | B | B | B | A |
| Ex. 17 | 25 | D | A | A | A | B | D | C | A |

TABLE 8-continued

| | Toner No. | Low-temperature fixability | Hot offset resistance | Thin line reproducibility Initial | Thin line reproducibility Temporal | Heat-resistant storage stability | Smear resistance | Background fouling (temporal) 1 magnetic roll | Background fouling (temporal) 2 magnetic rolls |
|---|---|---|---|---|---|---|---|---|---|
| Ex. 18 | 26 | D | C | A | A | C | B | C | A |
| Ex. 19 | 27 | A | C | A | A | A | B | C | A |
| Ex. 20 | 28 | B | D | A | B | C | B | C | A |
| Ex. 21 | 29 | B | C | A | B | C | B | C | A |
| Ex. 22 | 30 | C | A | A | A | A | B | C | A |
| Ex. 23 | 31 | D | A | A | A | A | B | C | A |
| Ex. 24 | 32 | A | B | A | A | B | A | C | A |
| Ex. 25 | 33 | A | C | A | A | B | A | C | A |
| Ex. 26 | 34 | A | B | A | A | A | A | C | A |
| Ex. 27 | 35 | A | B | C | D | C | A | C | A |
| Ex. 28 | 36 | B | A | A | A | B | A | C | A |
| Ex. 29 | 37 | A | A | A | A | A | A | C | A |
| Ex. 30 | 38 | A | A | A | A | A | A | C | A |

In accordance with some embodiments, a toner having a good combination of low-temperature fixability, hot offset resistance, and storage stability; and an image forming method and process cartridge that provide high-quality image for an extended period of time is provided.

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a crystalline polyester resin (A);

an amorphous resin (B); and a composite resin (C) having a condensation polymerization resin unit and an addition polymerization resin unit;

wherein a molecular weight distribution of the toner based on THF-soluble contents thereof has a main peak within a molecular weight range from 1,000 to 10,000 and a half bandwidth of the main peak is 15,000 or less, the molecular weight distribution being determined by gel permeation chromatography, wherein the toner includes chloroform-insoluble contents, and wherein a ratio C/R of the toner is within a range from 0.03 to 0.55, wherein C and R represent heights of spectrum peaks specific to the crystalline polyester resin (A) and the amorphous resin (B), respectively, determined by a Fourier transform infrared spectroscopic attenuation total reflection method after the toner is stored in a thermostatic chamber at 45° C. for 12 hours.

2. The toner according to claim 1, wherein an amount of the chloroform-insoluble contents in the toner is within a range from 1 to 30% by weight of the toner.

3. The toner according to claim 1, wherein the toner is manufactured by a method comprising melt-kneading step.

4. The toner according to claim 1, wherein the toner has an endothermic peak within a temperature range from 90 to 130° C. and an endothermic quantity of the endothermic peak is within a range from 1 to 15 J/g, the endothermic peak being determined by differential scanning calorimetry.

5. The toner according to claim 1, wherein the amorphous resin (B) includes:

an amorphous resin (B-1) including chloroform-insoluble contents; and an amorphous resin (B-2).

6. The toner according to claim 5, wherein an amount of the chloroform-insoluble contents in the toner is within a range from 5 to 40% by weight of the toner.

7. The toner according to claim 5, wherein a molecular weight distribution of the amorphous resin (B-2) based on THF-soluble contents thereof has a main peak within a molecular weight range from 1,000 to 10,000 and a half bandwidth of the main peak is 15,000 or less, the molecular weight distribution being determined by gel permeation chromatography.

8. The toner according to claim 1, wherein the amorphous resin (B) includes:

an amorphous resin (B-1); and an amorphous resin (B-2), wherein a softening temperature (T1/2) of the amorphous resin (B-1) is 25° C. or more higher than that of the amorphous resin (B-2).

9. The toner according to claim 8, wherein amorphous resin (B-1) is present in an amount of from 10 to 40% by weight of the toner, amorphous resin (B-2) is present in an amount of from 50 to 90% by weight of the toner, and composite resin (C) is present in an amount of from 3 to 20% by weight of the toner.

10. The toner according to claim 9, wherein the crystalline polyester resin (A) is present in an amount of from 1 to 15% by weight of the toner.

11. The toner according to claim 1, further comprising a fatty acid amide compound.

12. The toner according to claim 1, wherein the crystalline polyester resin (A) includes an ester bond represented by the following formula (I) in its main molecular chain;

$$[—OCO—R—OCO—(CH_2)_n—] \quad (I)$$

wherein R represents a straight-chain unsaturated aliphatic dicarboxylic acid residue having a carbon number of from 2 to 20, and n represents an integer of from 2 to 20.

13. The toner according to claim 1, wherein the condensation polymerization resin unit and the addition polymerization resin unit of the composite resin (C) are a polyester resin unit and a vinyl resin unit, respectively.

14. An image forming method, comprising:

forming an electrostatic latent image on an image bearing member;

developing the electrostatic latent image into a toner image with the toner according to claim 1;

transferring the toner image from the latent image bearing member onto a recording medium; and fixing the toner image on the recording medium.

15. The image forming method according to claim 14, wherein the developing includes developing the electrostatic latent image into a toner image with the toner according to claim 1 by a developing device having two or more magnetic rolls.

16. A process cartridge, detachably mountable on image forming apparatus, comprising:

an image bearing member; and a developing device adapted to develop an electrostatic latent image on the image bearing member into a toner image with a developer including the toner according to claim 1 and a carrier.

17. The toner according to claim 1, wherein the crystalline polyester resin (A) is present in an amount of from 1 to 15% by weight of the toner.

* * * * *